US010452016B2

(12) United States Patent
Kamoshida et al.

(10) Patent No.: US 10,452,016 B2
(45) Date of Patent: Oct. 22, 2019

(54) DRUM UNIT, PROCESS CARTRIDGE AND IMAGE FORMING APPARATUS

(71) Applicant: CANON KABUSHIKI KAISHA, Tokyo (JP)

(72) Inventors: Shigemi Kamoshida, Yokohama (JP); Yu Fukasawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/939,997

(22) Filed: Mar. 29, 2018

(65) Prior Publication Data

US 2018/0224794 A1 Aug. 9, 2018

Related U.S. Application Data

(63) Continuation of application No. PCT/JP2016/079879, filed on Sep. 30, 2016.

(30) Foreign Application Priority Data

Sep. 30, 2015 (JP) ..... 2015-193826

(51) Int. Cl.
*G03G 15/00* (2006.01)
*G03G 21/18* (2006.01)

(52) U.S. Cl.
CPC ..... *G03G 15/757* (2013.01); *G03G 21/1864* (2013.01); *G03G 21/1821* (2013.01); *G03G 21/1853* (2013.01)

(58) Field of Classification Search
CPC ..... G03G 15/757; G03G 15/00; G03G 21/16; G03G 21/1821
See application file for complete search history.

(56) References Cited

U.S. PATENT DOCUMENTS 8,437,669 B2 * 5/2013 Morioka ..... F16D 1/10 399/279
8,731,435 B2 5/2014 Xu
(Continued)

FOREIGN PATENT DOCUMENTS

CN 203573085 U 4/2014
EP 2 530 532 A1 12/2012
(Continued)

OTHER PUBLICATIONS

International Search Report and Written Opinion for International Patent Application No. PCT/JP2016/079879 (dated Dec. 27, 2016).
(Continued)

*Primary Examiner* — Sandra Brase
(74) *Attorney, Agent, or Firm* — Venable LLP

(57) ABSTRACT

A drum unit usable with a process cartridge includes a photosensitive drum having an axis L1; and a coupling member having an axis L2 and connected to an end portion of the photosensitive drum, the coupling member being provided with a projection extending toward an end portion of the coupling member, wherein the coupling member is movable along the axis L2 between a first position, and a second position in which the projection is closer to the photosensitive drum than in the first position, wherein the projection is provided with a force receiving portion for receiving a rotational force and an outer surface facing away from the axis L2, and wherein at least a part of the outer surface is more distant from the axis L2 as is further from the photosensitive drum in a direction of the axis L1.

27 Claims, 24 Drawing Sheets

(56) References Cited

U.S. PATENT DOCUMENTS

| | | | | |
|---|---|---|---|---|
| RE46,560 | E | 9/2017 | Takada | |
| 2008/0152388 | A1 | 6/2008 | Ueno et al. | |
| 2010/0034561 | A1* | 2/2010 | Batori | G03G 15/757 399/167 |
| 2010/0054823 | A1 | 3/2010 | Takasaka et al. | |
| 2013/0071141 | A1 | 3/2013 | Ueno et al. | |
| 2015/0030353 | A1 | 1/2015 | Wang | |
| 2015/0093150 | A1 | 4/2015 | Xiao et al. | |
| 2015/0168911 | A1 | 6/2015 | Kuruma et al. | |
| 2015/0177683 | A1 | 6/2015 | Gu et al. | |

FOREIGN PATENT DOCUMENTS

| | | | |
|---|---|---|---|
| JP | 2008-158081 | A | 7/2008 |
| JP | 2008-233867 | A | 10/2008 |
| JP | 2012-123392 | A | 6/2012 |
| JP | 2013133392 | A | 7/2012 |
| JP | 2015-099366 | A | 5/2015 |
| JP | 2015-118140 | A | 6/2015 |
| RU | 2 540 091 | C1 | 6/2013 |
| WO | 2015/043043 | A1 | 4/2015 |

OTHER PUBLICATIONS

Office Action in Taiwanese Patent Application No. 105131741, dated Oct. 18, 2017.

Office Action in Chinese Patent Application No. 201680059394.5, dated Feb. 1, 2019 (with English translation).

Extended Search Report in European Patent Application No. 16 851 949.4, dated Apr. 18, 2019.

Decision on Grant in Russian Patent Application No. 2018116004, dated Apr. 15, 2019 (with English translation).

* cited by examiner (a)

(b)

DRUM UNIT, PROCESS CARTRIDGE AND IMAGE FORMING APPARATUS

TECHNICAL FIELD

The present invention relates to an image forming apparatus for forming an electrophotographic image, a process cartridge, and a drum unit.

BACKGROUND ART

In an electrophotographic image forming apparatus, a structure is known in which elements such as a photosensitive drum and a developing roller as rotatable members contributable to image formation are integrated as a cartridge, and the cartridge can be mounted to and dismounted from the main assembly of the image forming apparatus (hereinafter referred to as apparatus main assembly). Here, in order to rotate the photosensitive drum in the cartridge, it is desirable to transmit the driving force from the main assembly of the device. At that time, it is known that a coupling member on the cartridge side is engaged with a driving force transmission portion such as a drive pin on the side of the main assembly to transmit the driving force.

Here, a structure of a cartridge that is removable in a predetermined direction substantially perpendicular to the rotation axis of the photosensitive drum is known. Japanese Laid-open Patent Application No. 2008-233867 discloses a structure in which a coupling member provided at the end portion of the photosensitive drum can incline relative to the rotation axis of the photosensitive drum. it is known that by doing so, a coupling member mounted on a cartridge is engaged with a driving pin provided in the main assembly of the apparatus, and a driving force is transmitted from the apparatus main assembly to the cartridge

SUMMARY OF THE INVENTION

Problem to be Solved by the Invention

It is an object of the present invention to develop the above-mentioned conventional technique.

Means for Solving the Problem

According to an aspect of the present invention, there is provided a drum unit usable with a process cartridge, said drum unit comprising a photosensitive drum having an axis L1; and a coupling member having an axis L2 and connected to an end portion of said photosensitive drum, said coupling member being provided with a projection extending toward an end portion of said coupling member, wherein said coupling member is movable along the axis L2 between a first position, and a second position in which said projection is closer to said photosensitive drum than in the first position, wherein said projection is provided with a force receiving portion for receiving a rotational force and an outer surface facing away from the axis L2, and wherein at least a part of the outer surface is more distant from the axis L2 as is further from said photosensitive drum in a direction of the axis L1.

Effect of the Invention

The above-described conventional technique can be developed.

Figure 4:
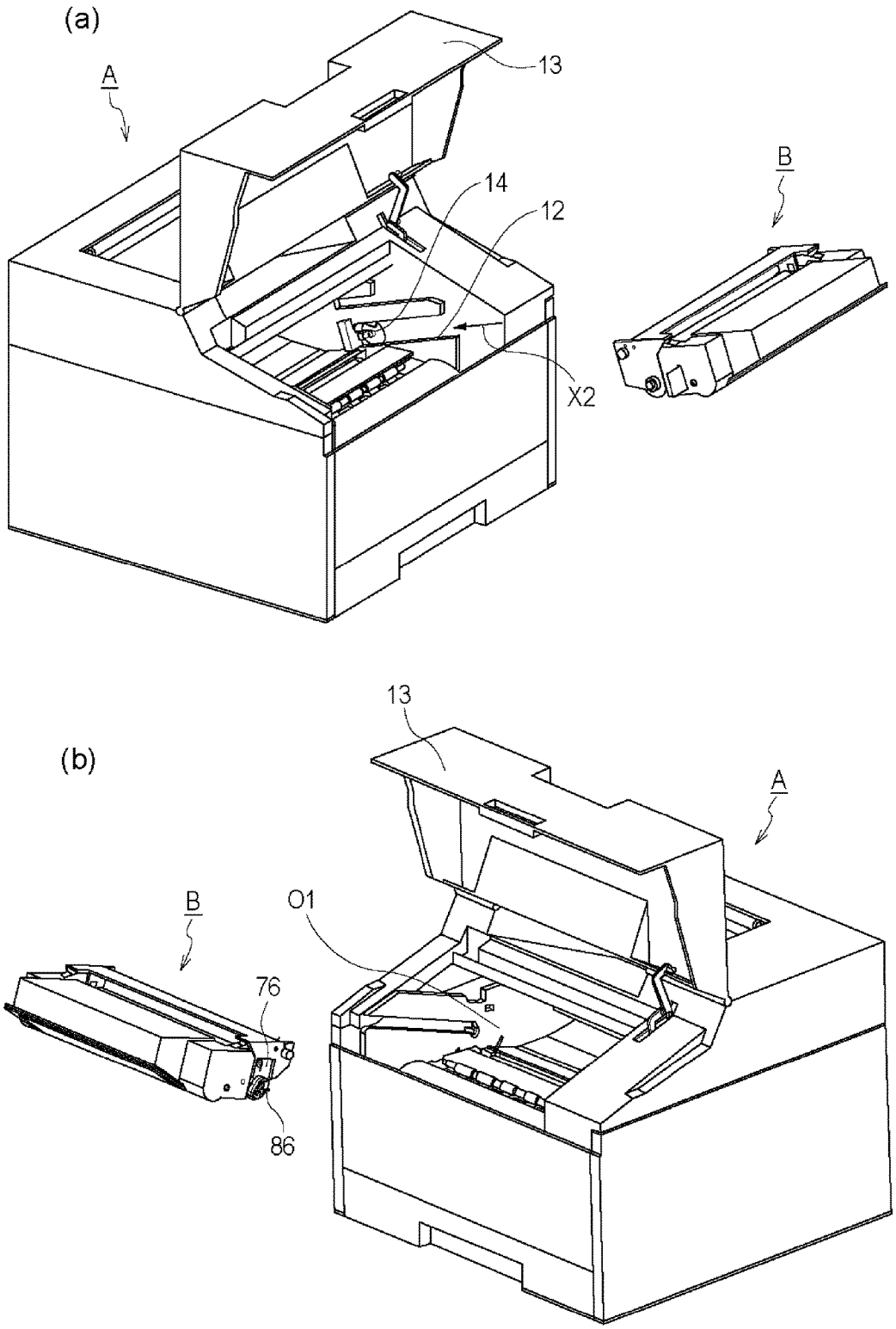

Part (a) and part (b) FIG. 4 illustrate mounting and dismounting of the cartridge.

Figure 5:
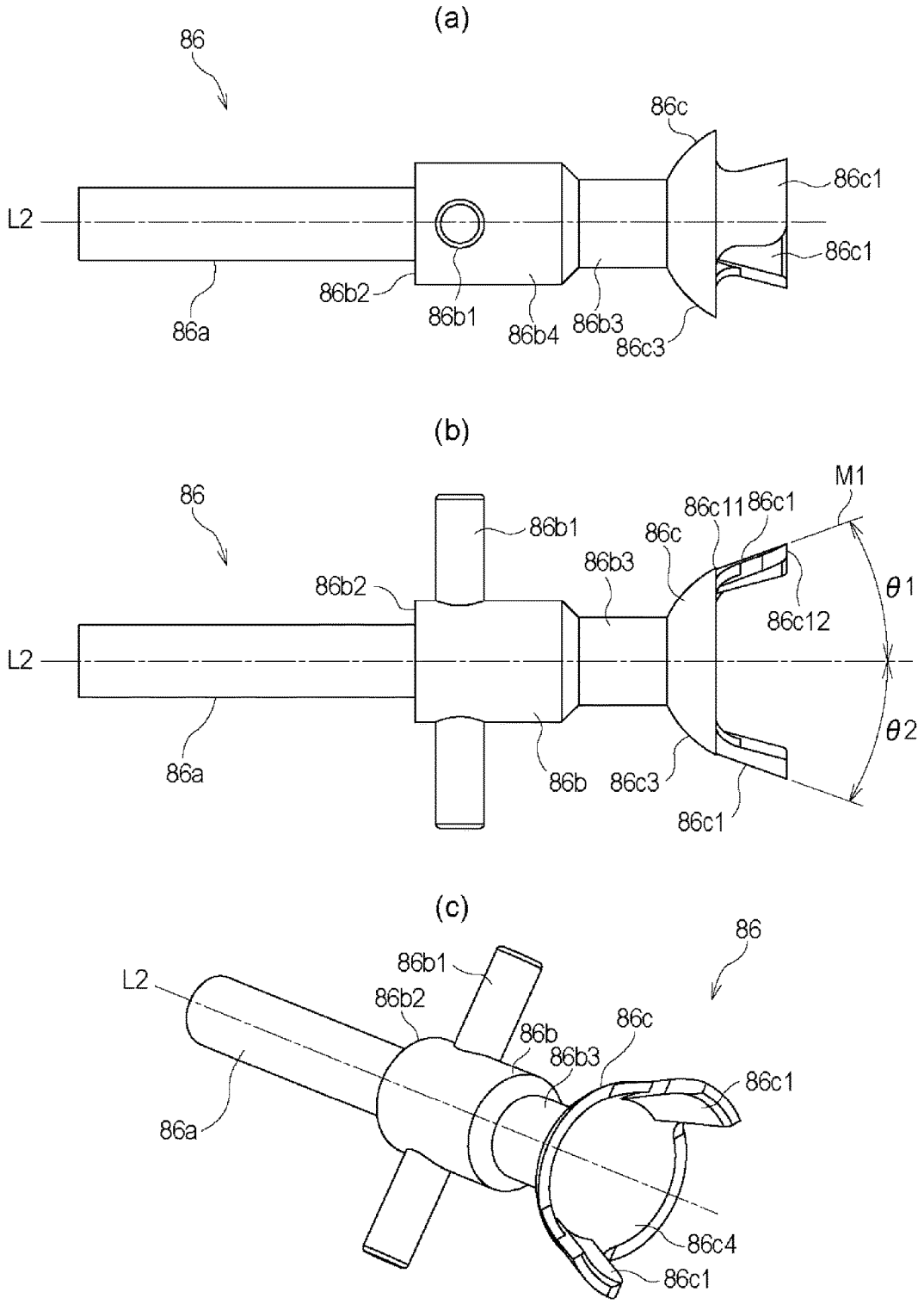

Part (a) of FIG. 5 and part (b) of FIG. 5 are side views of the coupling member, and FIG. 5 (*c*) is a perspective view of the coupling member.

Figure 6:
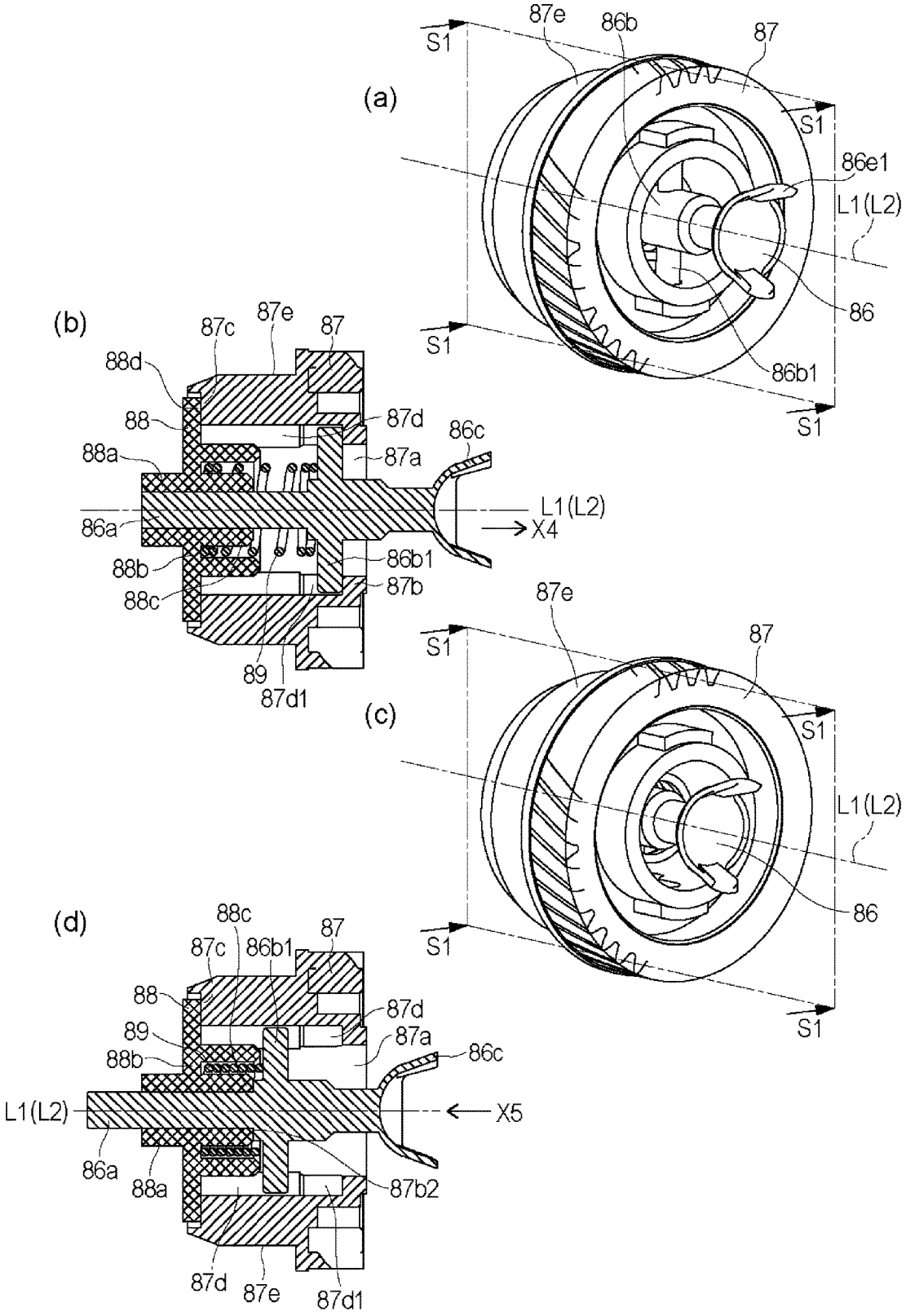

Part (a) of FIG. 6 and part (c) of FIG. 6 are perspective views of the drum gear unit, and part (b) of FIG. 6 and part (d) of FIG. 6 are sectional views of the drum gear unit.

Figure 7:
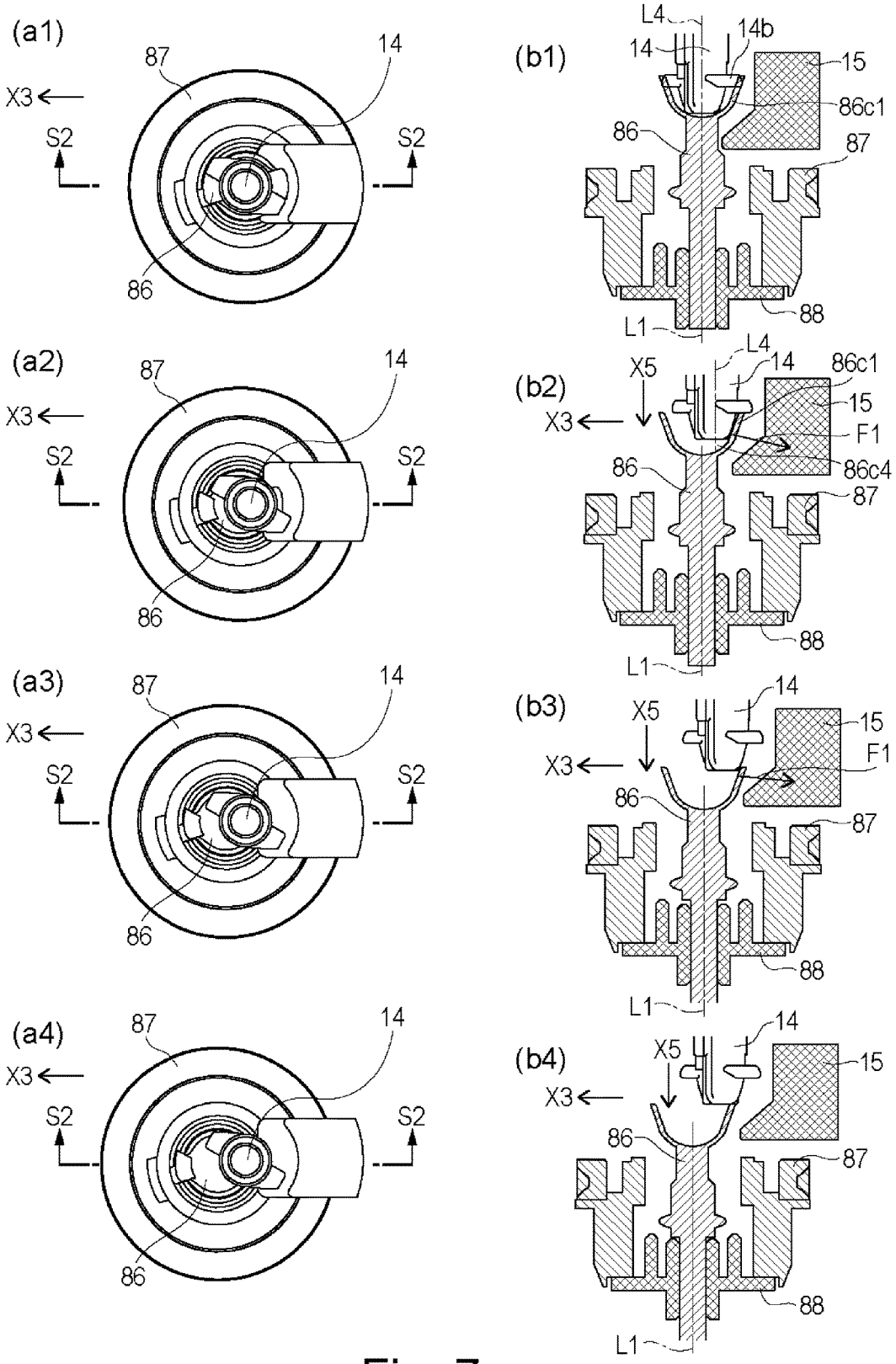

Part (a1) of FIG. 7, part (a2) thereof, part (a3) thereof, and part (a4) thereof illustrate the gear unit, and parts (b1), (b2), (b3) and (b4) of FIG. 7 are sectional views of the drum gear units.

Figure 8:
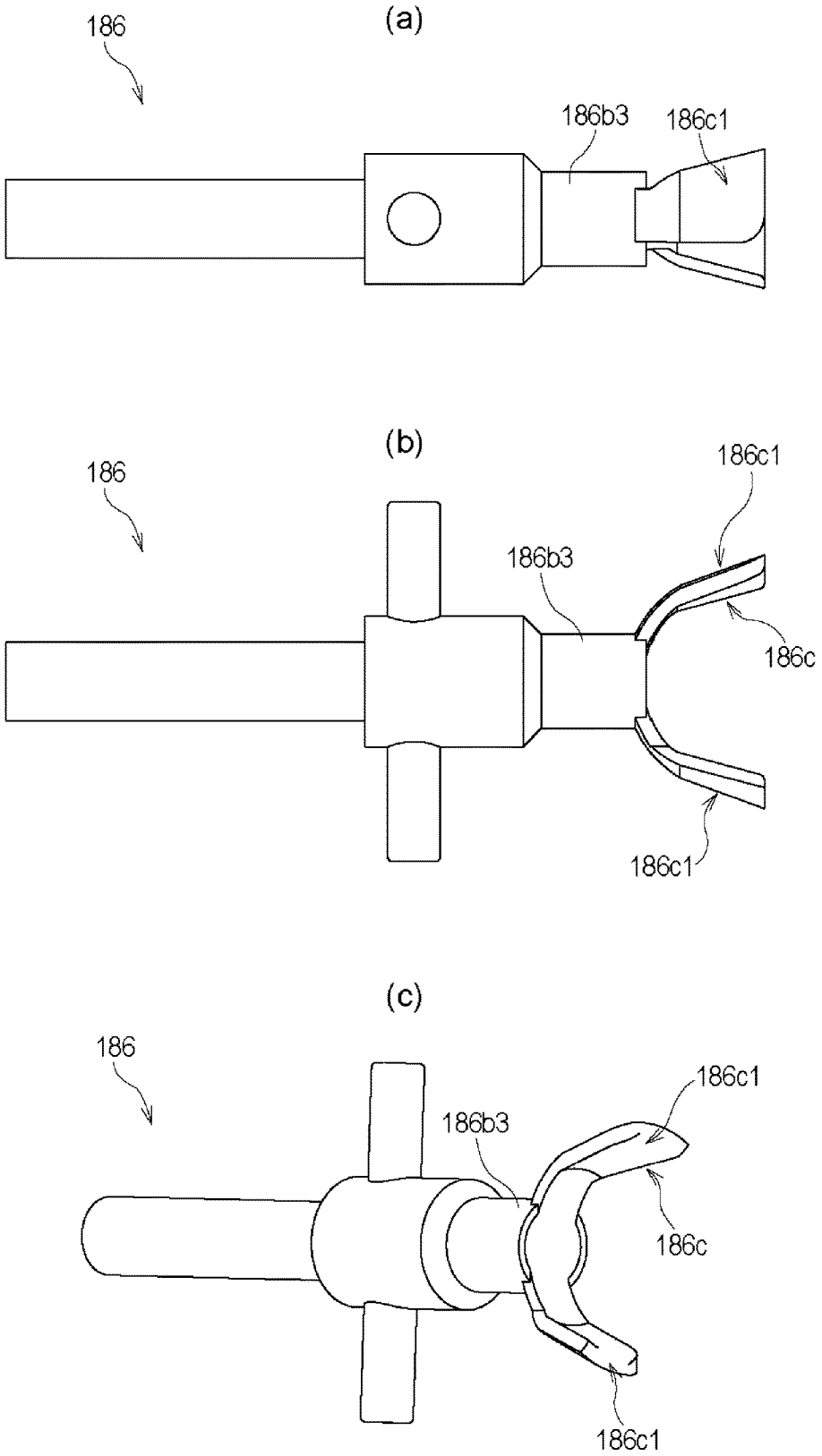

FIG. 8 illustrates a modification of the Embodiment 1.

Figure 9:
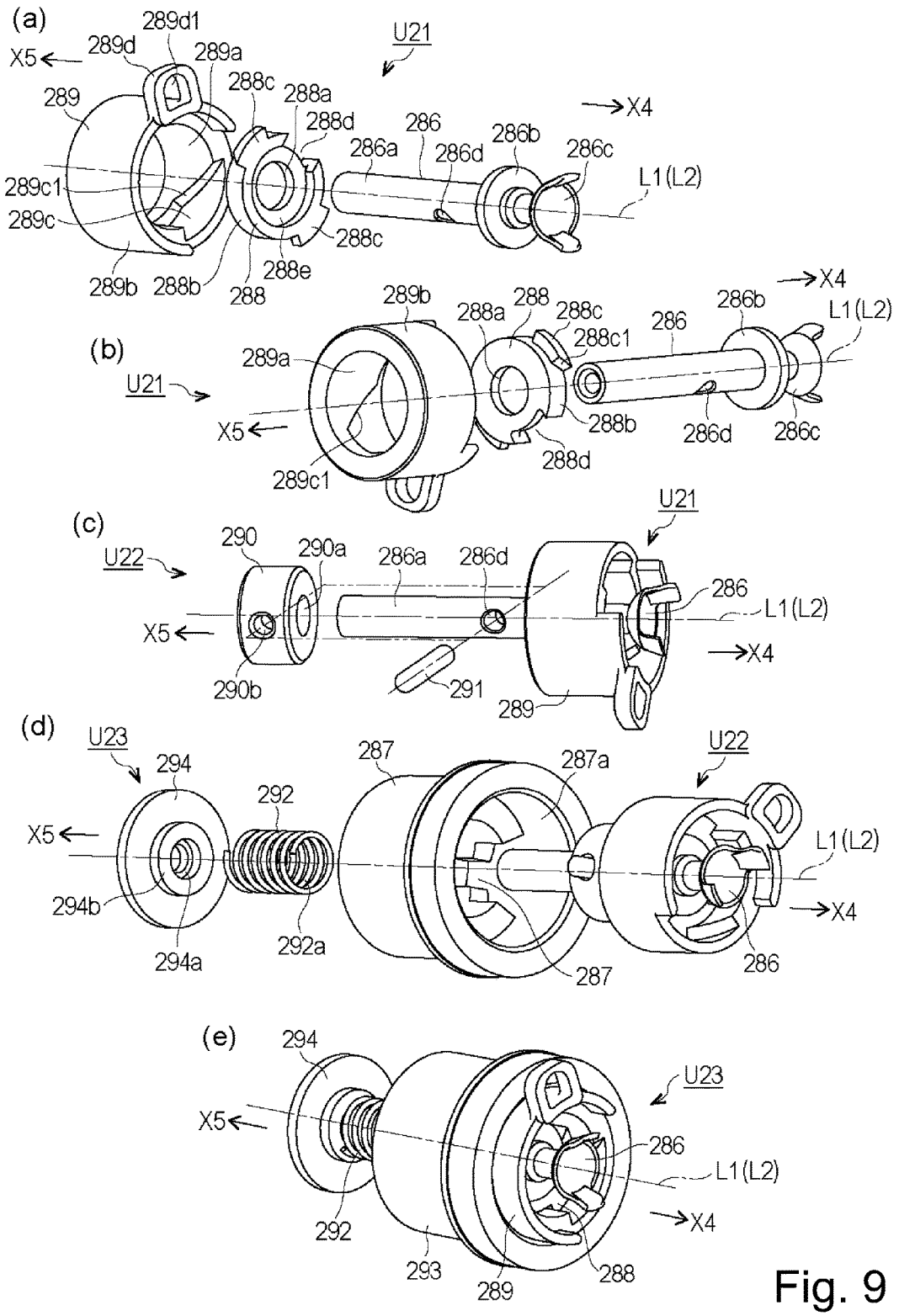

Part (a) of FIG. 9, part (b) thereof, part (c) thereof, part (d) thereof and part (e) thereof are perspective views of a drum gear unit.

Figure 10:
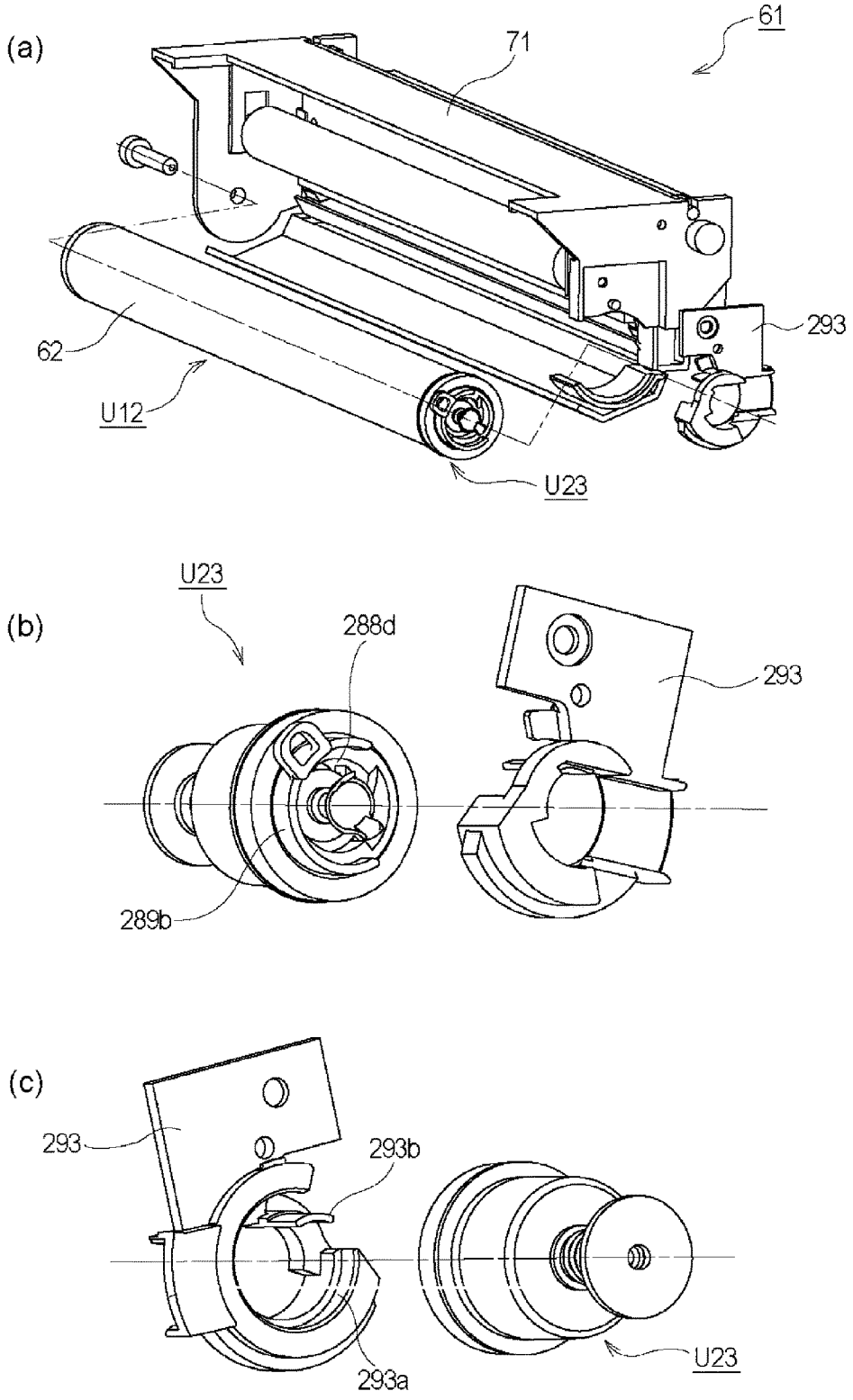

Part (a) of FIG. 10, part (b) of FIG. 10 and part (c) of FIG. 10 are exploded perspective views of a cleaning unit.

Figure 11:
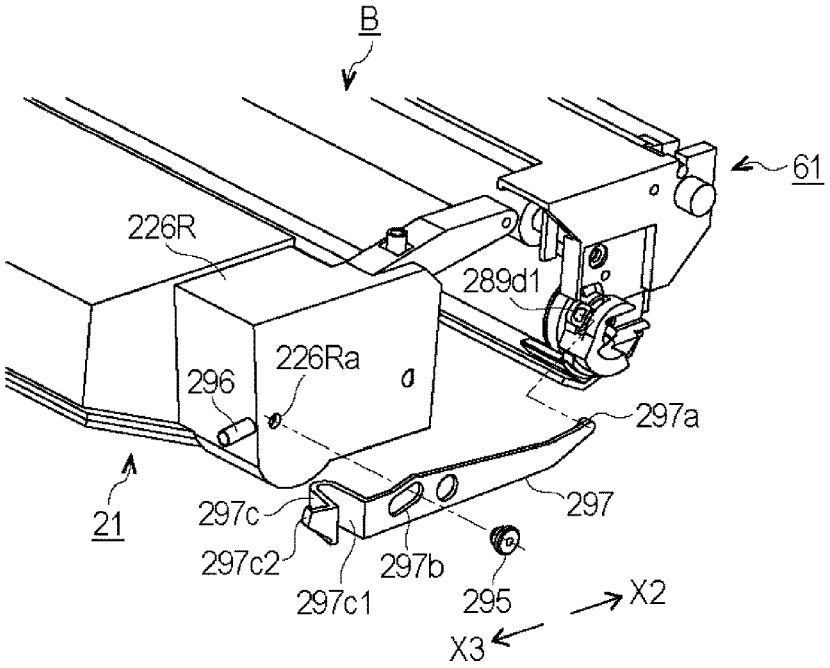
Figure 11:
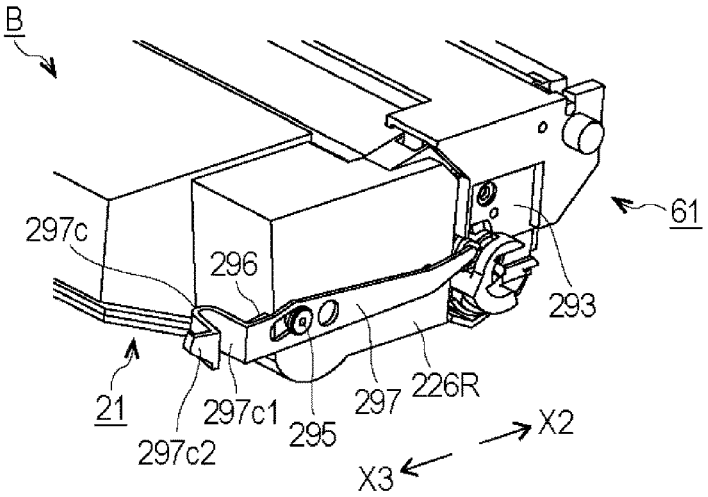

Part (a) of FIG. 11 and part (b) of FIG. 11 are perspective views of the cartridge.

Figure 12:
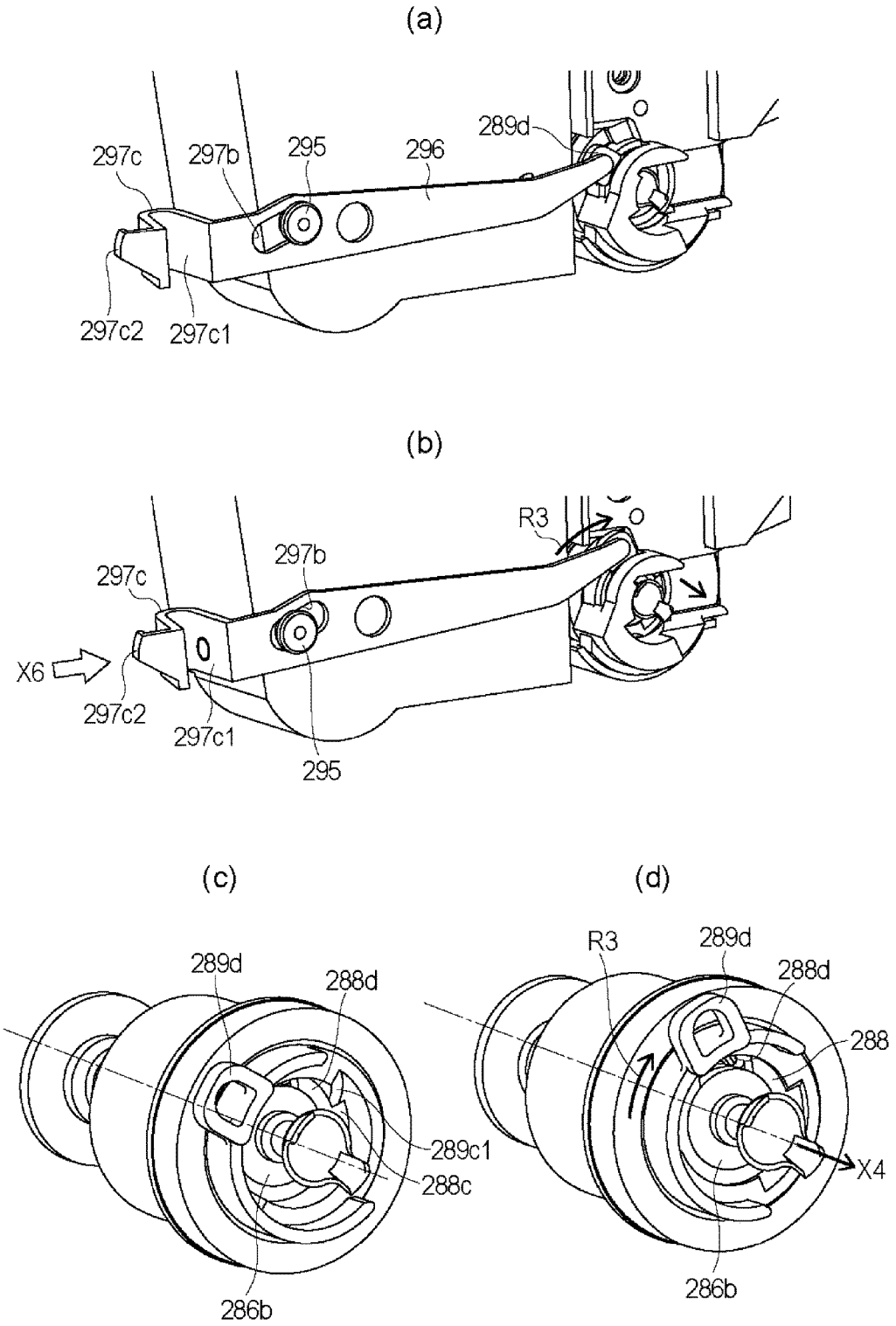

Part (a) of FIG. 12, part (b) of FIG. 12, part (c) of FIG. 12 and part (d) of FIG. 12 illustrate the operation of the drum gear unit.

Figure 13:
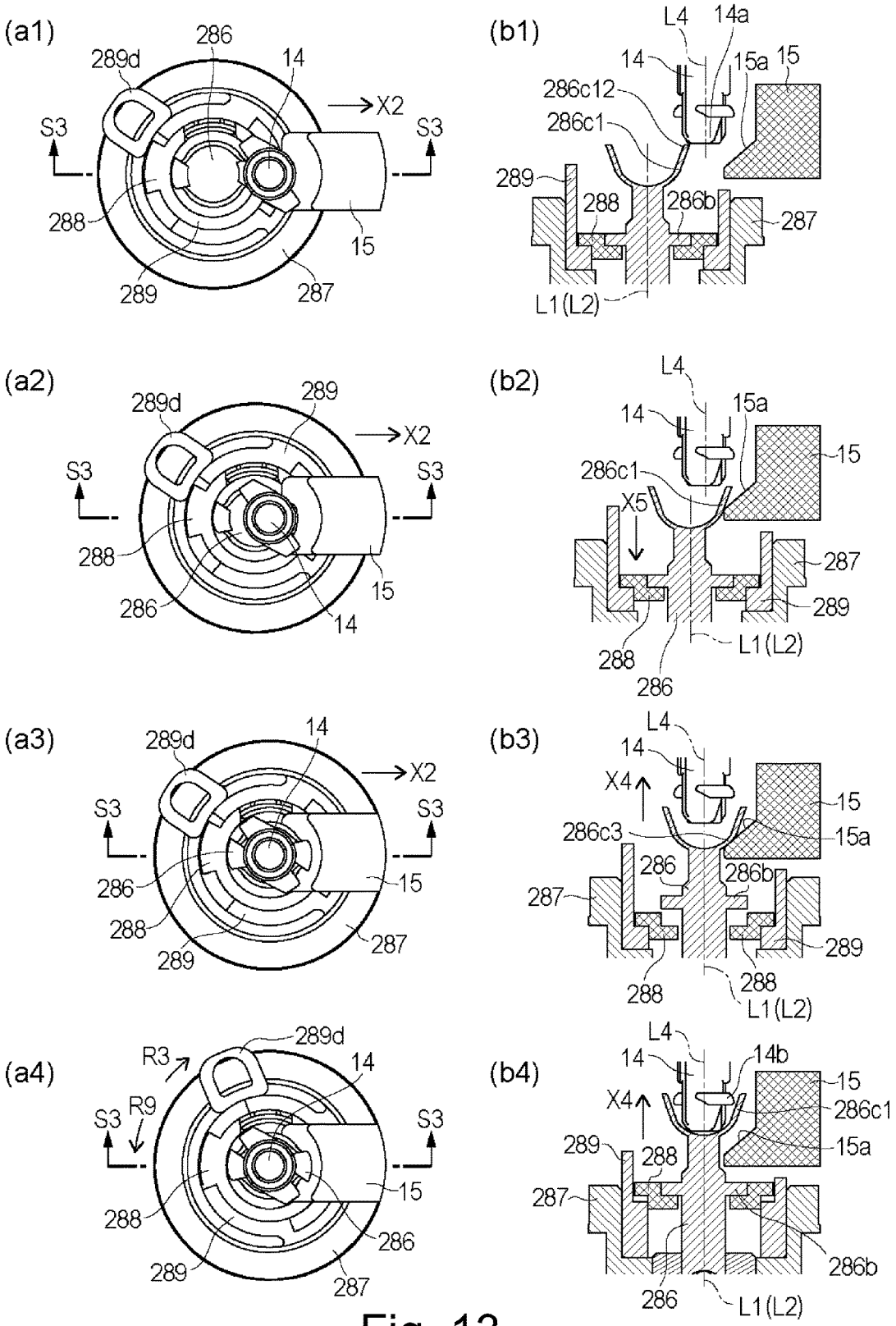

Part (a1) of FIG. 13, part (a2) thereof, part (a3) thereof, and part (a4) thereof illustrate a drum gear unit, and part (b1) of FIG. 13, part (b2) thereof, part (b3) thereof and part (b4) thereof are sectional views of the drum gear unit.

Figure 14:
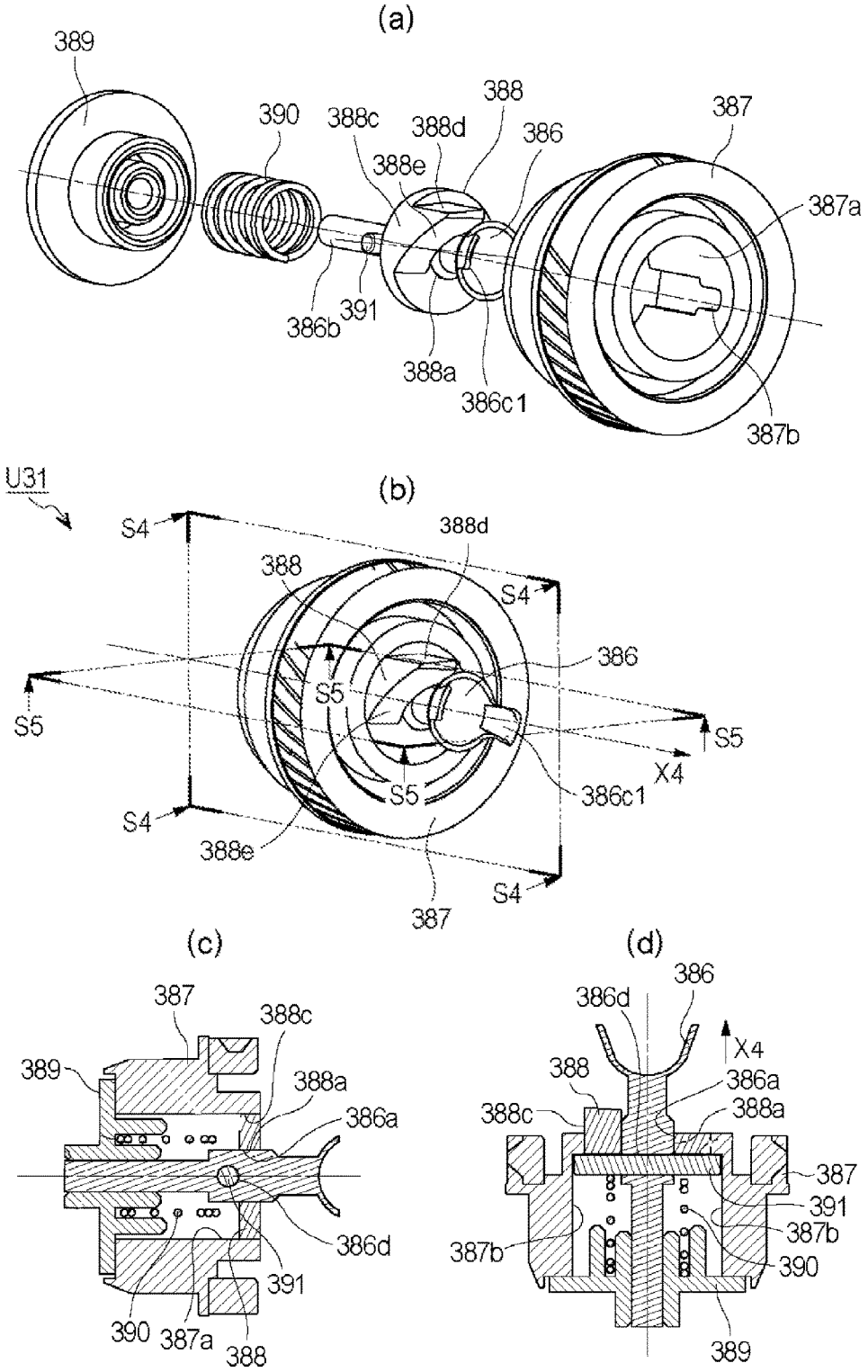

Part (a) of FIG. 14 and part (b) of FIG. 14 are perspective views of the drum gear unit, and part (c) of FIG. 14 and part (d) of FIG. 14 are sectional views of the drum gear unit.

Figure 15:
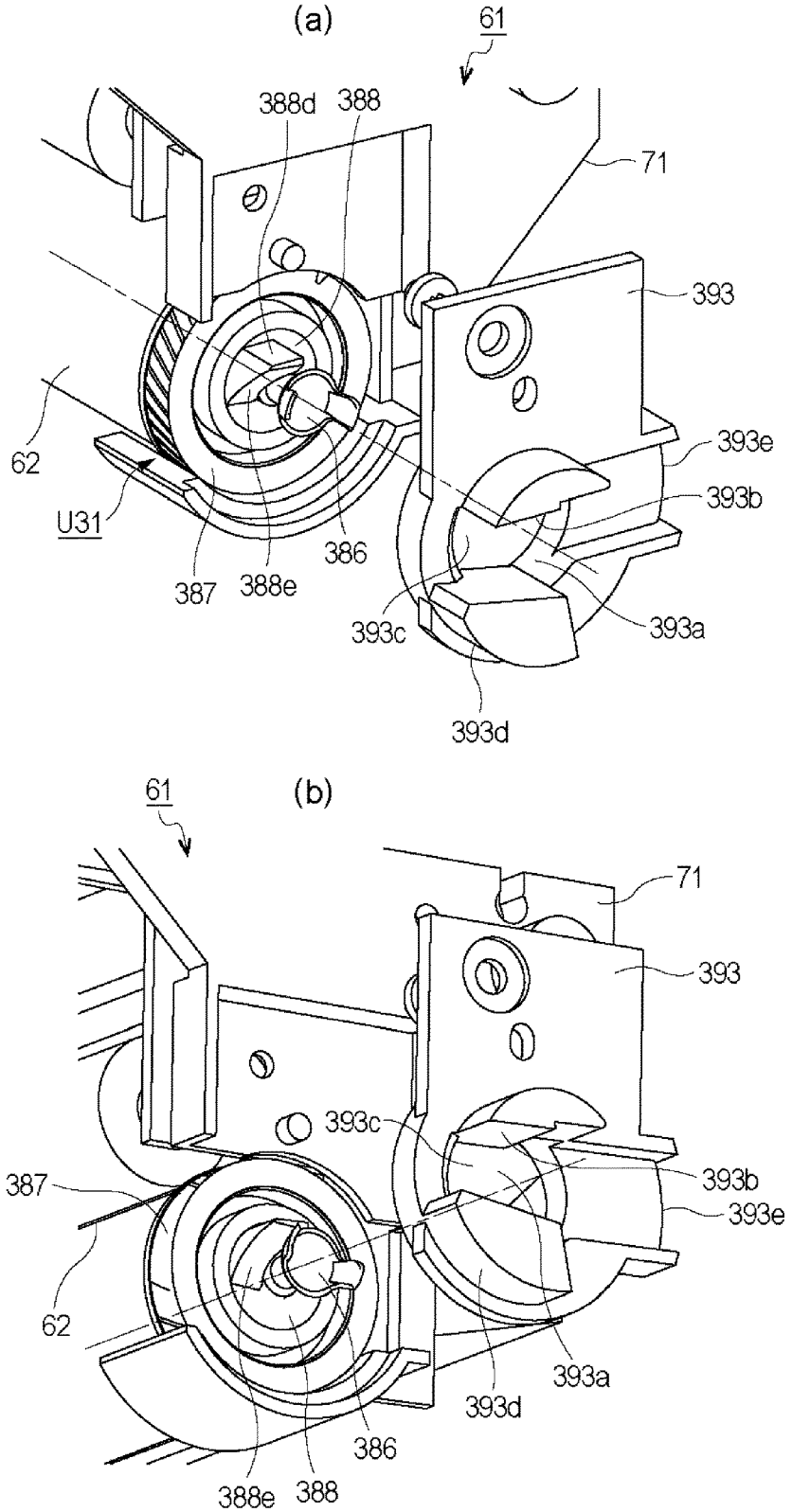

Part (a) of FIG. 15 and part (b) thereof illustrate the drum gear unit.

Figure 16:
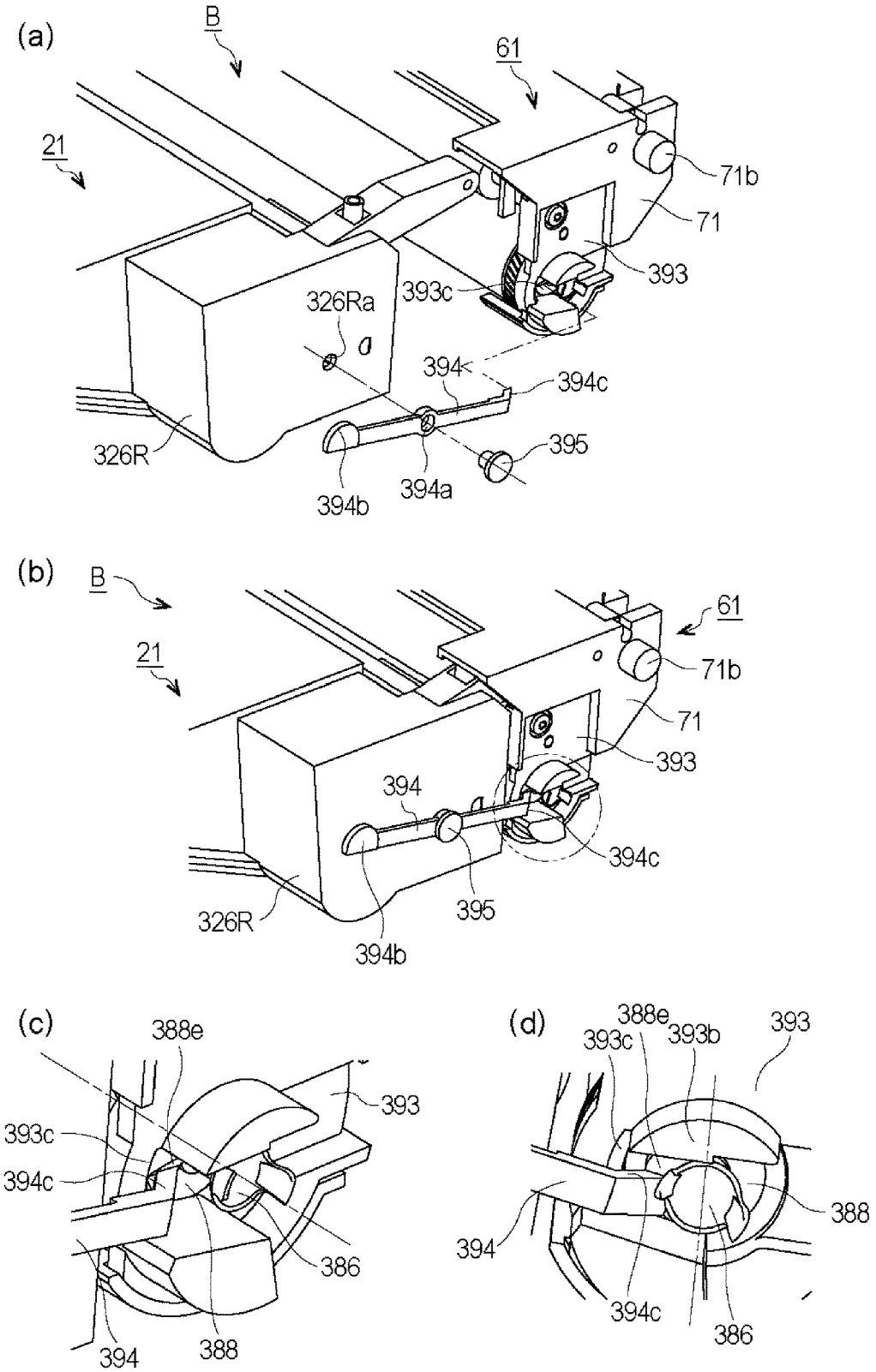

Part (a) of FIG. 16, part (b) thereof, part (c) thereof and part (d) thereof illustrate the drum gear unit.

Figure 17:
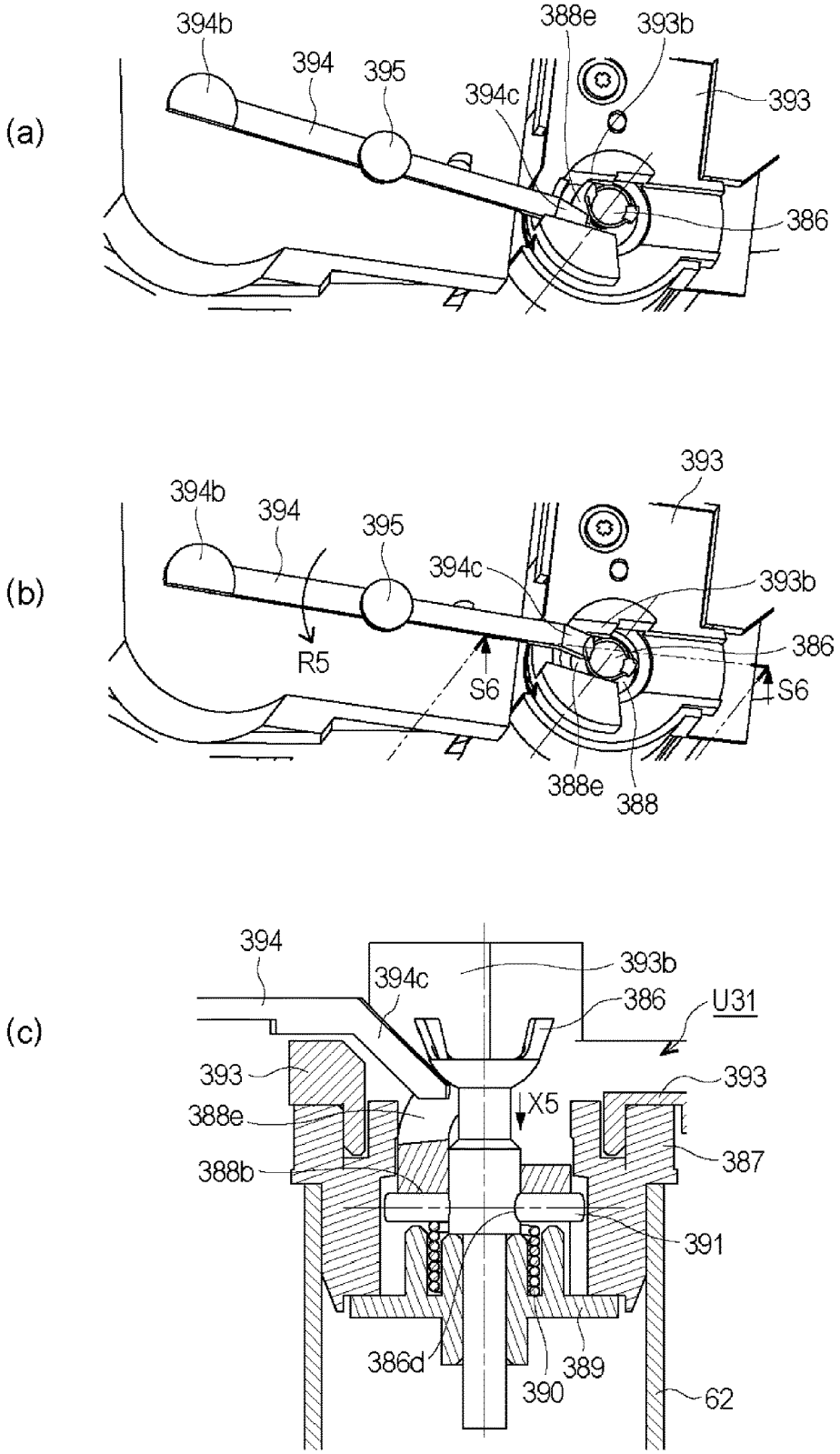

Part (a) of FIG. 17, part (b) of FIG. 17 and part (c) of FIG. 17 illustrate the drum gear unit.

Figure 18:
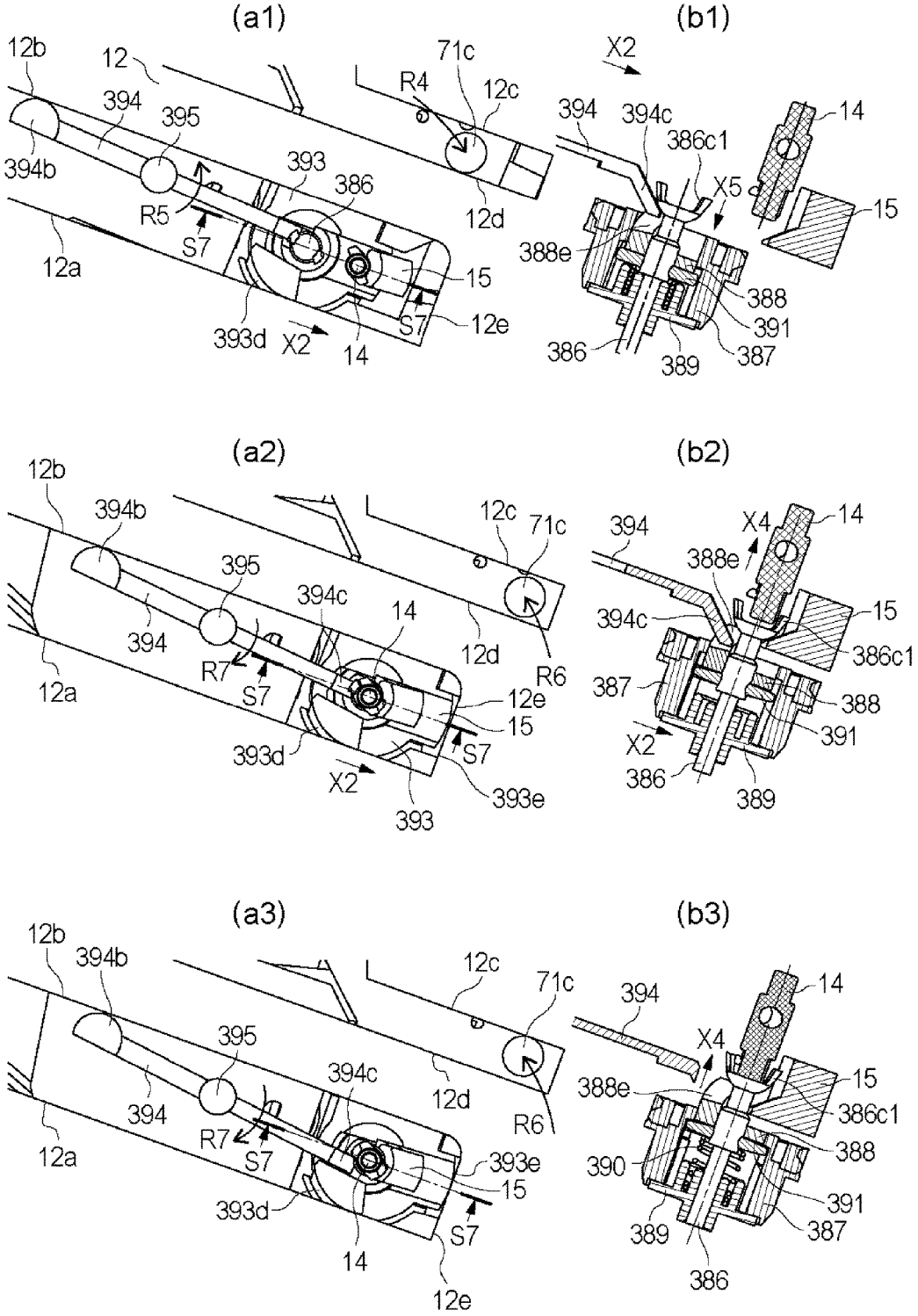

Part (a1) of FIG. 18, part (a2) thereof, and part (a3) thereof show the drum gear unit, and part (b1) of FIG. 18, part (b2) thereof and part (b3) thereof are sectional views of a drum gear unit.

Figure 19:
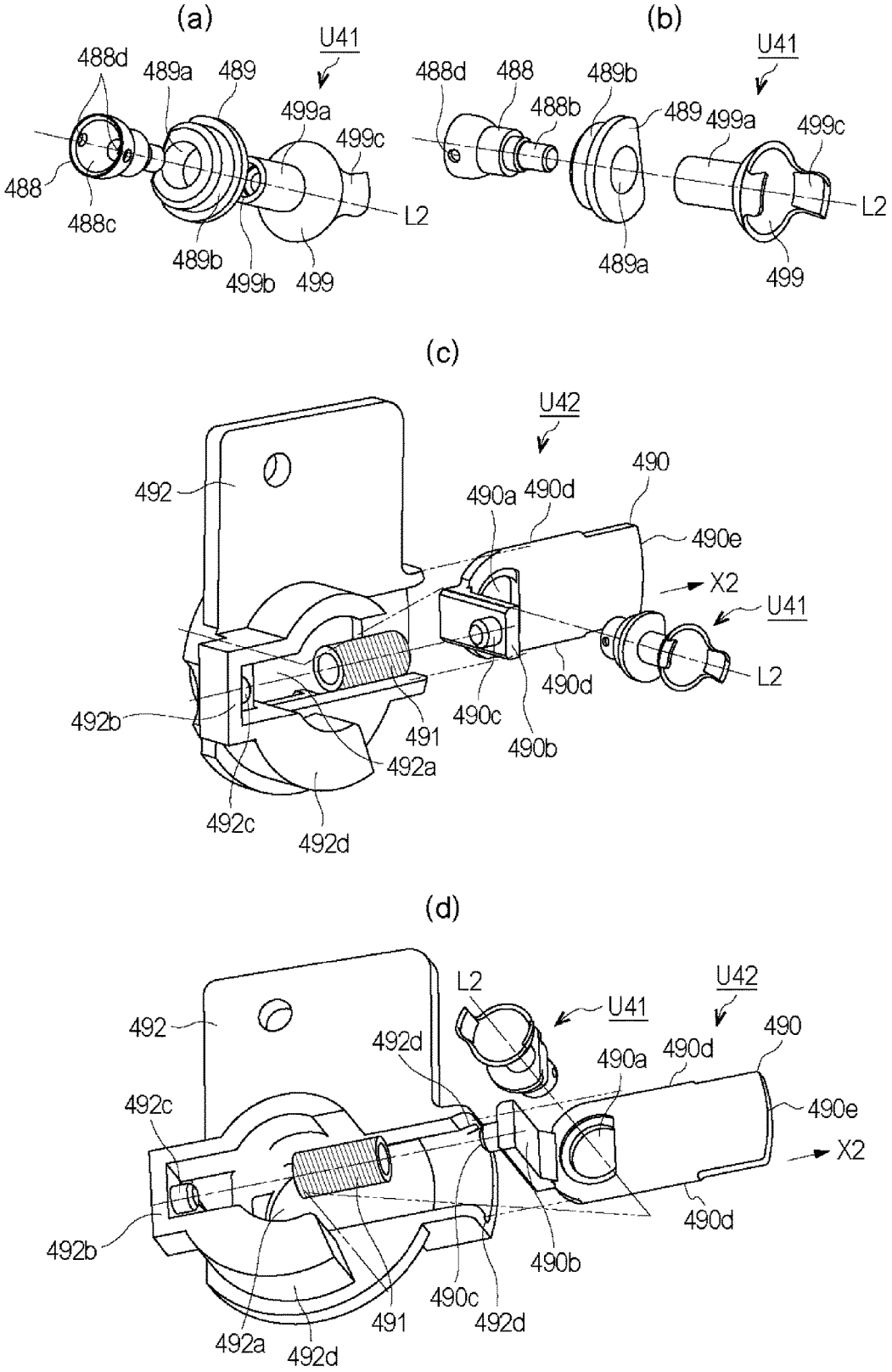

Part (a) of FIG. 19, part (b) thereof, part (c) thereof and part (d) thereof illustrate the drum gear unit.

Figure 20:
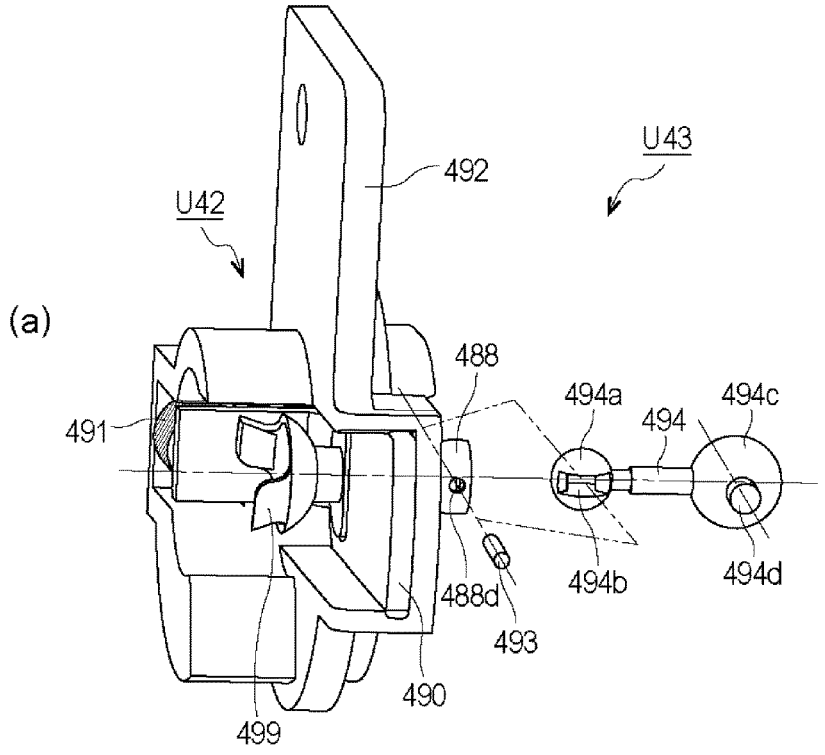
Figure 20:
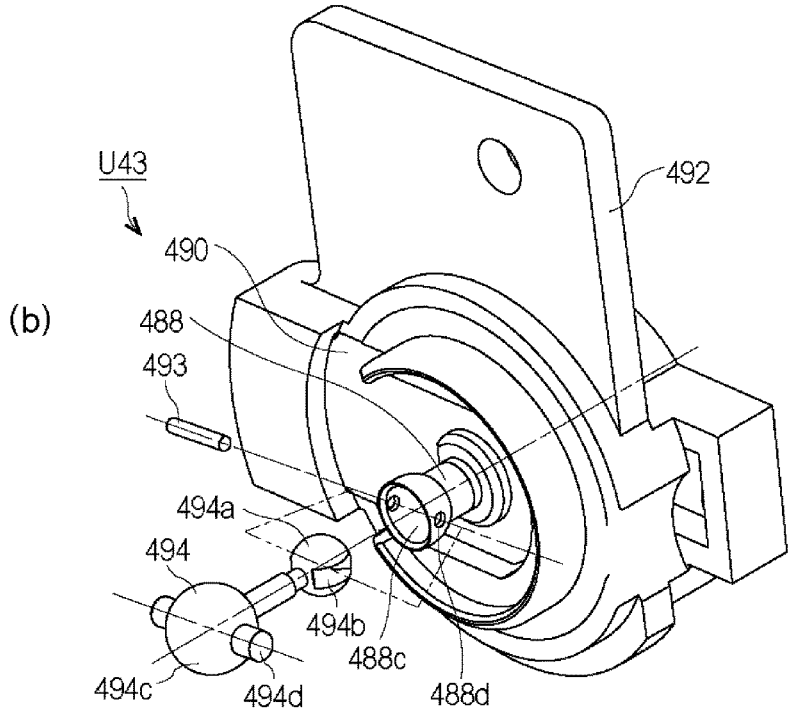

Part (a) of FIG. 20 and part (b) of FIG. 20 illustrate the drum gear unit.

Figure 21:
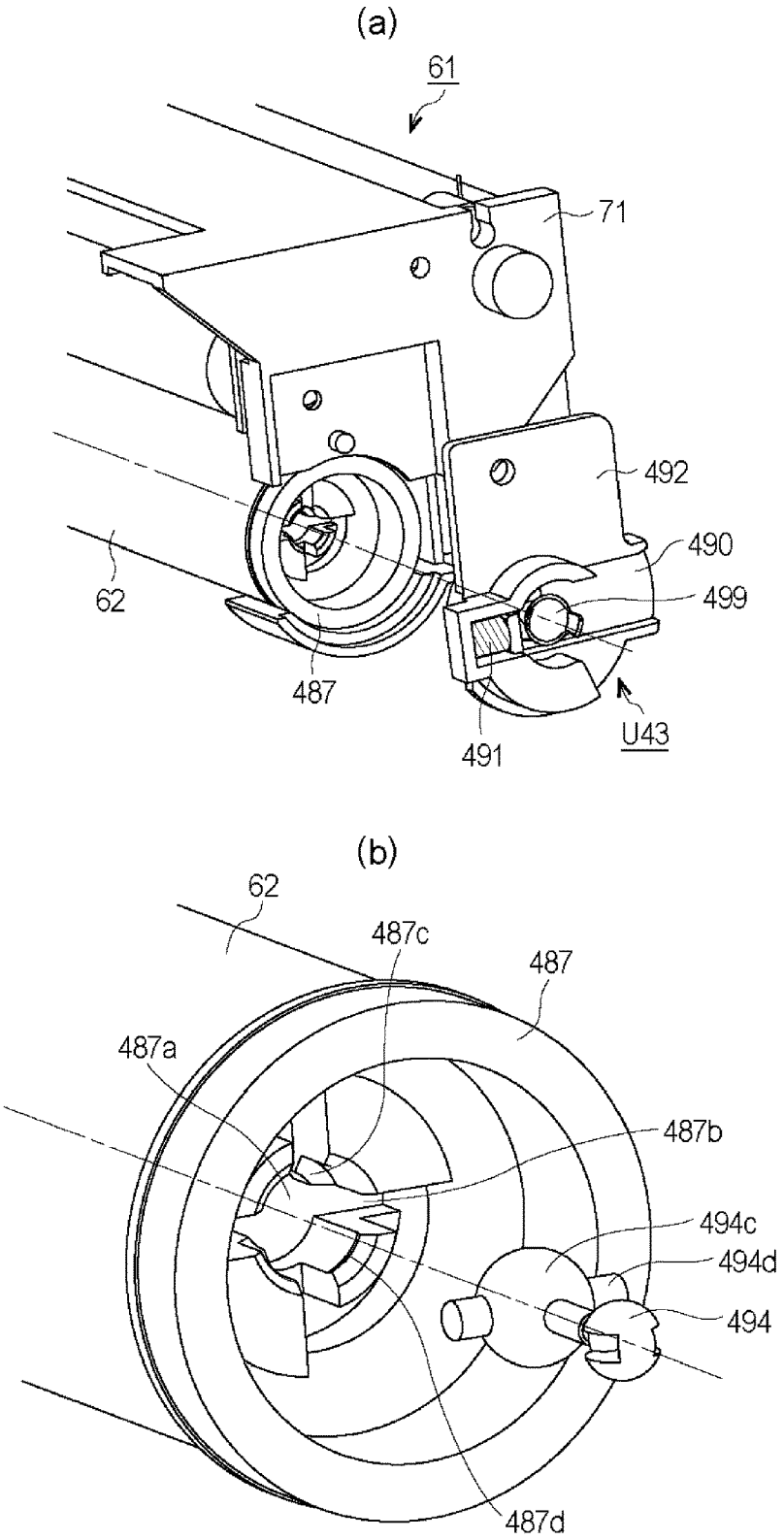

Part (a) of FIG. 21 and part (b) of FIG. 21 illustrate the drum gear unit.

Figure 22:
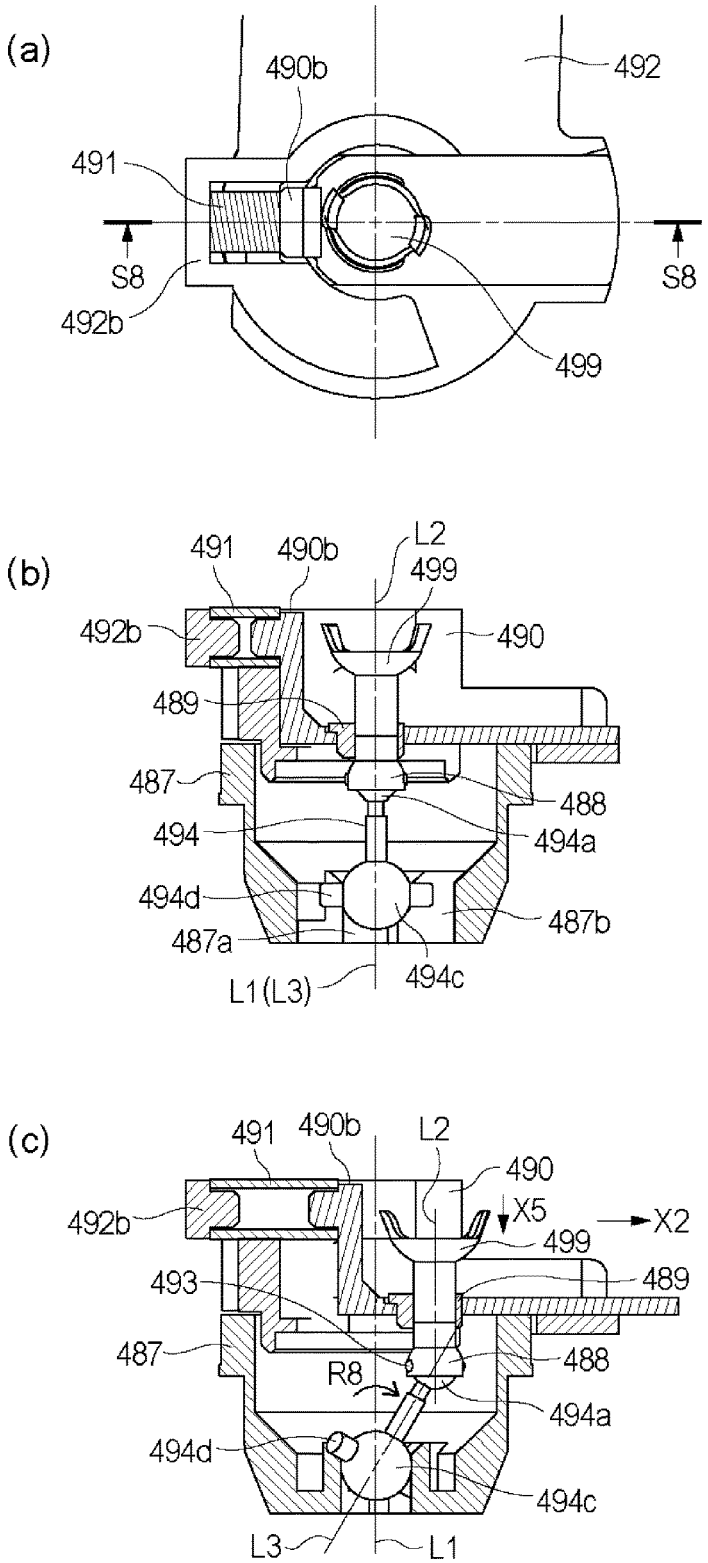

Part (a) of FIG. 22, part (b) of FIG. 22 and part (c) of FIG. 22 illustrate the drum gear unit.

Figure 23:
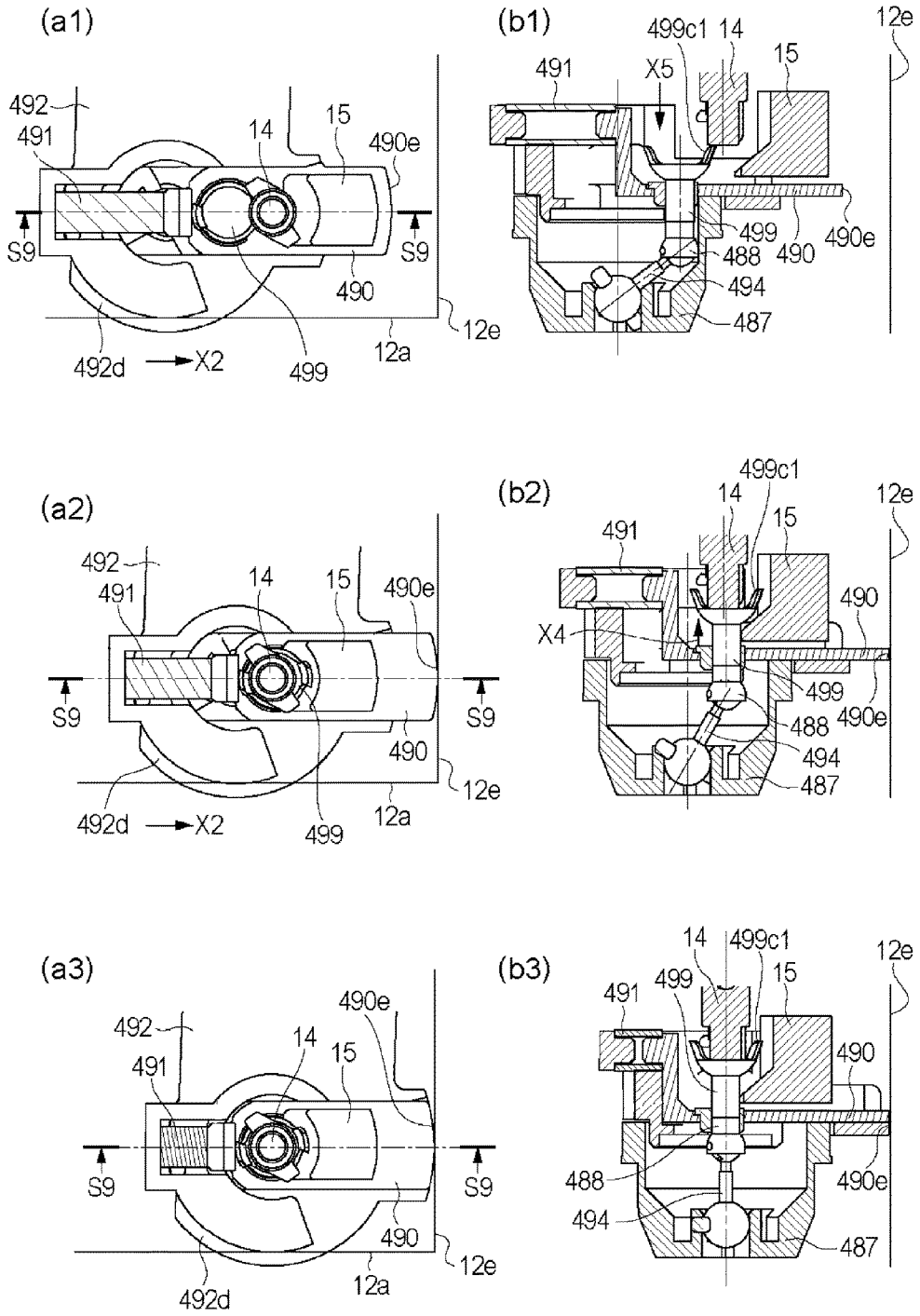

Part (a1) of FIG. 23, part (a2) thereof, and part (a3) thereof show a drum gear unit, and part (b1) of FIG. 23, part (b2) thereof, and part (b3) thereof are sectional views of a drum gear unit.

Figure 24:
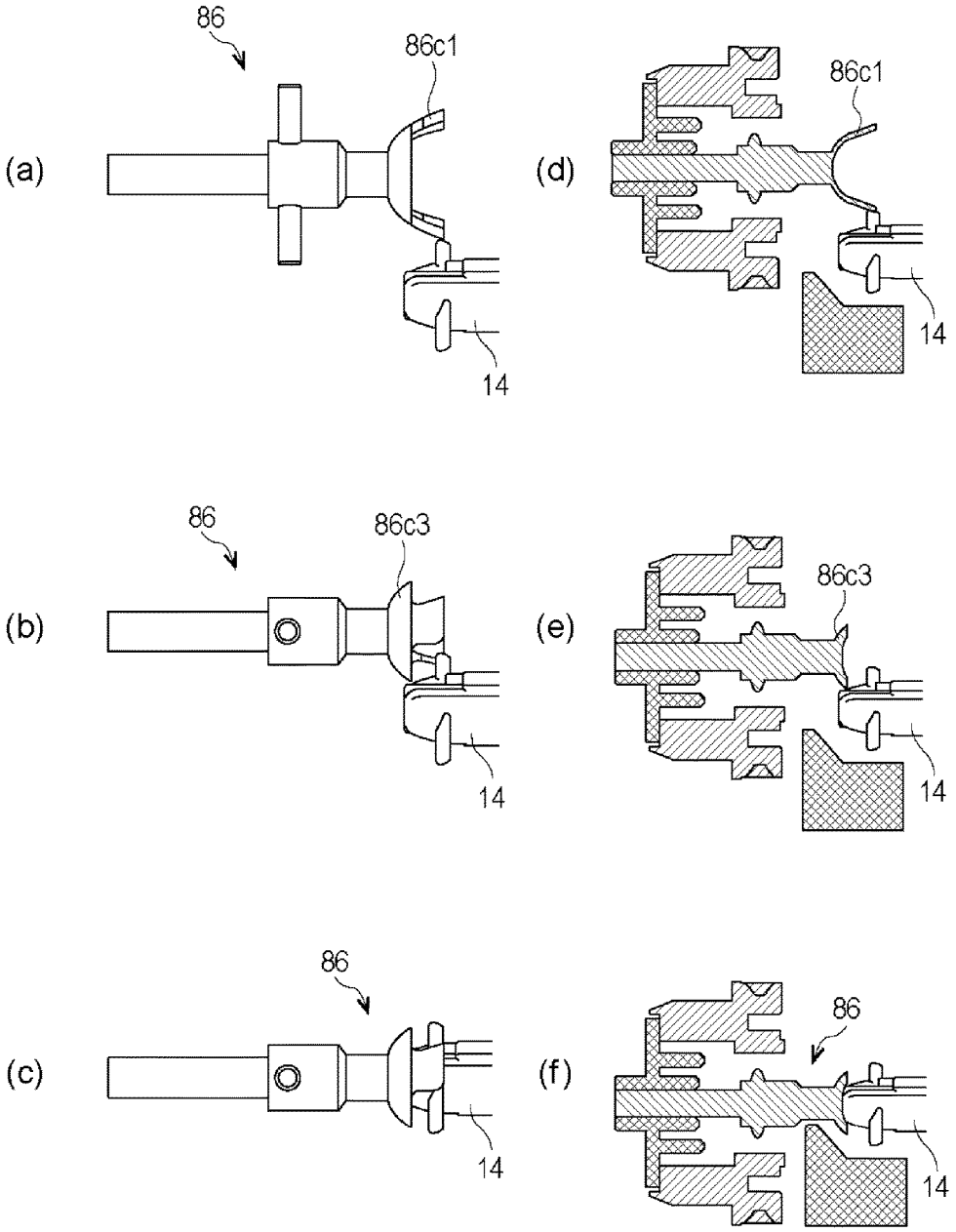

Part (a) of FIG. 24, part (b) of FIG. 24 and part (c) of FIG. 24 illustrate the coupling member, and part (d) of FIG. 24, part (e) of FIG. 24 and part (f) of FIG. 24 are sectional views of the coupling member.

Figure 25:
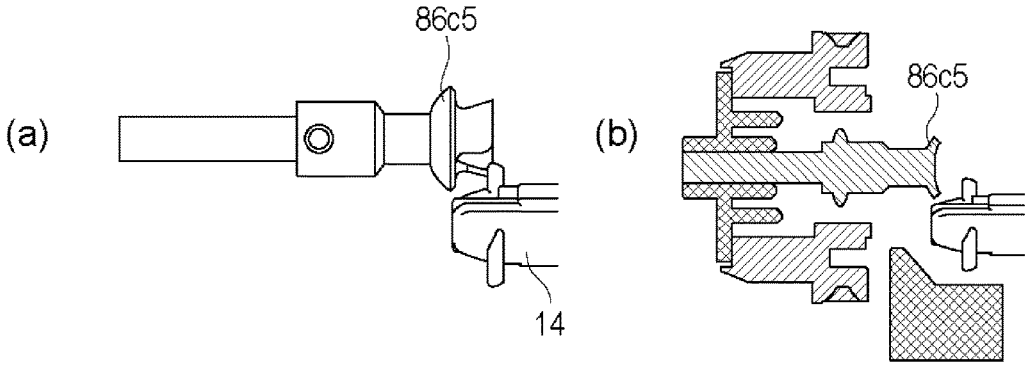

Part (a) of FIG. 25 is an illustration illustrating a modified example of the coupling member, and FIG. 25 (*b*) is a sectional view illustrating a modified example of the coupling member.

DETAILED DESCRIPTION OF THE INVENTION

Hereinafter, embodiments to which the present invention is applied will be described in conjunction with the drawings.

Here, an image forming apparatus (an image forming apparatus for forming an electrophotographic image) employing an electrophotographic method is referred to as an electrophotographic image forming apparatus. The electrophotographic method is a method of developing an electrostatic image formed on a photosensitive member with toner. Here, the developing method may be a one-component developing method, a two-component developing method, a developing method such as dry developing or the like. In addition, the electrophotographic photosensitive drum (electrophotographic photosensitive drum) is used for an electrophotographic image forming apparatus, and has a structure in which a photosensitive member (photosensitive layer) is provided on a cylindrical surface layer of a drum-shaped cylinder.

Here, a charging roller, a developing roller, etc. relating to image formation and acting on the photosensitive drum is called a process means. In addition, a cartridge comprising a photosensitive member or process means (cleaning blade, developing roller, and so on) related to image formation is called a process cartridge. In the embodiment, a process cartridge in which a photosensitive drum, a charging roller, a developing roller, and a cleaning blade are integrated into a unit will be described.

In the embodiment, a laser beam printer will be taken among electrophotographic methods used for wide variety of applications such as multifunction peripheral, FAX, printer, and so on. The reference numerals in the examples are used for referring to the drawings and do not limit the constitution of the present invention. The dimensions and so on in the examples are used for explaining the relationships clearly and do not limit the structure of the present invention.

The longitudinal direction of the process cartridge in the embodiment is a direction substantially perpendicular to the direction in which the process cartridge is mounted to and dismounted from the main assembly of the electrophotographic image forming apparatus. The longitudinal direction of the process cartridge is parallel to the rotation axis of the electrophotographic photosensitive drum (the direction crossing the sheet feeding direction). In the longitudinal direction, the side where the photosensitive drum receives rotational force from the image forming apparatus main assembly of the process cartridge is a driving side (driven side), and the opposite side thereof is a non-driving side. In addition, without specific reference, the upper (upper side) and the lower (lower side) are based on the direction of the gravity in the state that the image forming apparatus is installed.

Embodiment 1

The laser beam printer of this embodiment will be described with reference to the drawings. The cartridge in this embodiment is a process cartridge in which 'a photosensitive drum as a photosensitive member (image bearing member/rotatable member)' and 'a' developing roller, a charging roller, a cleaning blade as a process means are integrated. This cartridge is dismountably mountable relative to the main assembly of the machine. Here, gears, photosensitive drums, flanges, developing rollers, etc. are provided in the cartridge as rotatable members/rotating members which receive rotation force from the main assembly of the operation to rotate.

Figure 1:
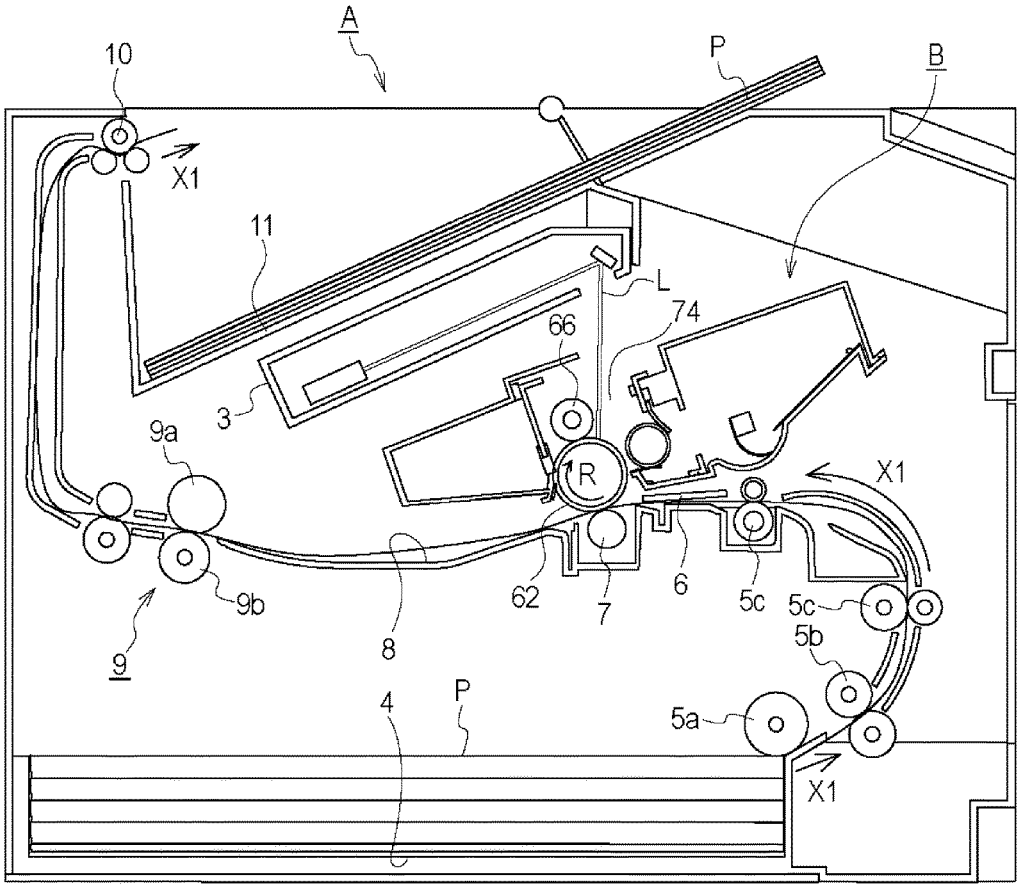
FIG. 1 is a cross-sectional view of an image forming apparatus.

Referring to FIG. 1, the structure of a laser beam printer as an electrophotographic image forming apparatus and an image forming process will be described below. Then, the detailed structure of the process cartridge will be explained referring to FIG. 2 and FIG. 3.

(Laser Beam Printer and Image Forming Process)

Figure 2:
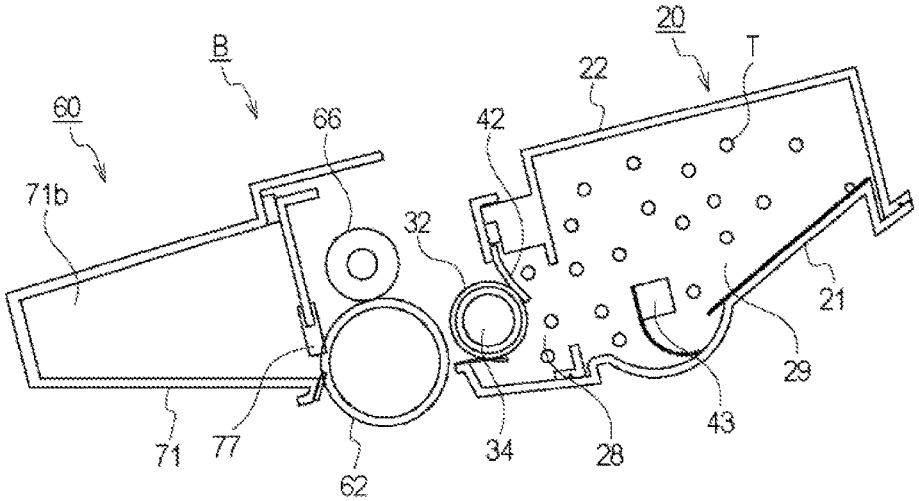
FIG. 2 is a sectional view of the cartridge.

FIG. 1 is a cross-sectional view of a laser beam printer main assembly A (hereinafter referred to as apparatus main assembly A) and a process cartridge (hereinafter referred to as cartridge B) which is an electrophotographic image forming apparatus. Also, FIG. 2 is a sectional view of the cartridge B.

Hereinafter, the apparatus main assembly A refers to a part of a laser beam printer as an electrophotographic image forming apparatus excluding a removable cartridge B.

First, referring to FIG. 1, the structure of a laser beam printer as an electrophotographic image forming apparatus will be described.

The electrophotographic image forming apparatus shown in FIG. 1 is a laser beam printer using an electrophotographic technique in which a cartridge B is dismountably mountable to (dismountable from) the apparatus main assembly A. When the cartridge B is mounted in the apparatus main assembly A, the cartridge B is disposed below the laser scanner unit 3 as the exposure means (exposure device).

Further, below the cartridge B, there is provided a sheet tray 4 containing a sheet P as a recording medium (sheet material) as an image forming object (object) on which the image forming apparatus forms an image.

Further, in the main assembly A of the apparatus, a pickup roller 5*a*, a pair of feeding rollers 5*b*, a pair of feeding rollers 5*c*, a transfer guide 6, a transfer roller 7, a feeding guide 8, a fixing device 9, a pair of discharge rollers 10, and a discharge tray 11 are provided in the order named from the upstream side along the feeding direction X1 of the sheet P. The fixing device 9 as the fixing means includes the heating roller 9*a* and the pressure roller 9*b*.

Next, referring to FIGS. 1 and 2, the outline of the image forming process will be described.

Based on the print start signal, the drum cylinder 62 as a rotatable photosensitive drum bearing developer is rotated at a predetermined circumferential speed in the direction of arrow R (hereinafter referred to as rotational direction R)).

The charging roller 66 to which the bias voltage is applied contacts the outer circumferential surface of the drum cylinder 62 and uniformly charges the outer circumferential surface of the drum cylinder 62.

The laser scanner unit 3 as the exposure means outputs the laser light L corresponding to the image information inputted to the laser printer. The laser beam L scans and exposes the outer circumferential surface of the drum cylinder 62 through the exposure window 74 on the upper surface of the cartridge B. By this, a part of the charged drum cylinder 62 is neutralized, so that an electrostatic image (electrostatic latent image) is formed on the surface of the photosensitive drum.

On the other hand, as shown in FIG. 2, in a developing unit 20 as a developing device, the developer (hereinafter referred to as toner T) in a toner chamber 29 is fed to a feeding screw 43 and is stirred and fed by rotation, and is fed to a toner supply chamber 28.

The toner T as a developer is carried on a surface of a developing roller 32 as a developing means (process means, rotatable member) by a magnetic force of a magnet roller 34 (fixed magnet). The developing roller 32 functions as a toner carrying member (developer carrying member, developing member) which carries and feeds the developer to the developing area to develop the electrostatic image formed on the drum cylinder 62. The toner T fed to the developing area is regulated in the layer thickness on the peripheral surface of the developing roller 32 by a developing blade 42. The toner T is triboelectrically charged between the developing roller 32 and the developing blade 42.

In this manner, the toner T carried by the developing roller 32 develops (visualizes) the electrostatic image formed on the drum cylinder 62. The drum cylinder 62 rotates in the rotational direction R while carrying the toner (toner image) developed on its surface. The drum cylinder 62 is an image bearing member which carries a toner image.

As shown in FIG. 1, in timed relation with the output timing of the laser beam L, the pickup roller 5*a*, the pair of feeding rollers 5*b*, and the pair of feeding rollers 5*c* feed the sheet P stored in the lower portion of the apparatus main assembly A from the sheet tray 4.

Then, the sheet P is supplied to the transfer position (transfer nip) between the drum cylinder 62 and the transfer roller 7 by the way of the transfer guide 6. At this transfer position, the toner image is sequentially transferred from the drum cylinder 62 as the image bearing member to the sheet P as the recording medium.

The sheet P onto which the toner image has been transferred is separated from the drum cylinder 62 and fed to the fixing device 9 along the feeding guide 8. The sheet P passes through the fixing nip portion between the heating roller 9*a* and the pressure roller 9*b* constituting the fixing device 9. In this fixing nip portion, the unfixed toner image on the sheet P is fixed to the sheet P by being pressed and heated. After that, the sheet P on which the toner image is fixed is fed by the discharge roller pair 10 and discharged to the discharge tray 11.

On the other hand, as shown in FIG. 2, after transferring the toner T to the sheet, untransferred residual toner remaining on the drum surface without being transferred onto the sheet adheres on the surface of the drum cylinder 62. The untransferred residual toner is removed by a cleaning blade 77 which is in contact with the circumferential surface of the drum cylinder 62. By this, the toner remaining on the drum cylinder 62 is removed, and the cleaned drum cylinder 62 is recharged and then used for the image forming process. The toner (untransferred residual toner) removed from the drum cylinder 62 is stored in a waste toner chamber 71*b* of the cleaning unit 60.

In the above description, the charging roller 66, the developing roller 32, and the cleaning blade 77 function as process means acting on the drum cylinder 62. In the image forming apparatus of this embodiment, a method of removing the untransferred residual toner with the cleaning blade 77 is employed. However, it is also possible to employ a system (cleanerless system) in which the untransferred residual toner having adjusted charge is collected back at the same time as development action by the developing device. In the cleanerless system, an auxiliary charging member (auxiliary charging brush and so on) for adjusting the charge of the untransferred residual toner also functions as the process means.

(Structure of Process Cartridge)

Figure 3:
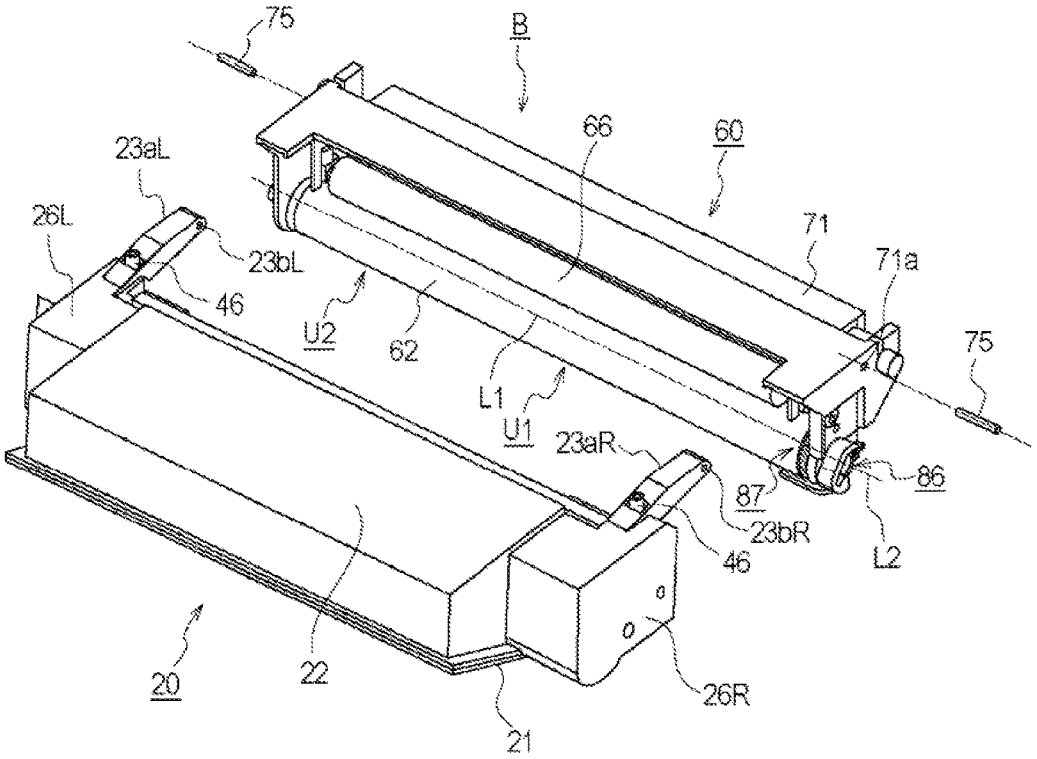
FIG. 3 is an exploded perspective view of the cartridge.

Referring to FIGS. 2 and 3, the detailed structure of the cartridge B will be described.

FIG. 3 is an exploded perspective view of the cartridge B. The cartridge B has a frame rotatably supporting the drum cylinder 62 and the developing roller 32. The frame of cartridge B can be disassembled into multiple units. In the cartridge B of this embodiment, the cleaning unit 60 and the developing unit 20 are integrated, and the frame of the cleaning unit 60 and the frame of the developing unit 20 constitute the cartridge B.

In this embodiment, the cleaning unit 60 for holding the drum cylinder 62 and the developing unit 20 for holding the developing roller 32 are connected by the two connecting pins 75. However, when the cartridge B comprises three or more units into which the cartridge B may be divided. Needless to say, only a part of the units without being coupled by a connecting member such as a pin may be made exchangeable.

The cleaning unit 60 includes a cleaning frame 71, a drum unit U1, a charging roller 66, a cleaning blade 77, and the like. The cartridge B has a frame which rotatably supports the drum cylinder 62 and the developing roller 32.

The drum unit U1 comprises a drum cylinder unit U2, a coupling member 86 and a pin 88 (see FIG. 6) provided at the drive side end of the drum cylinder unit U2. The coupling member 86 is for receiving the rotational force for rotating the drum unit U1 from the outside of the drum unit U1.

Further, the drum cylinder unit U2 has the drum cylinder 62 and a drive side flange 87 as a flange member mounted to the drive side of the drum cylinder 62 (details will be described hereinafter).

To the drum cylinder 62, a rotational force is transmitted from the apparatus main assembly A by way of the driving side flange 87 and the coupling member 86.

As shown in FIG. 3, the drum cylinder 62 is rotatable about a rotation axis L1 (hereinafter referred to as an axis L1). The coupling member 86 is rotatable about a rotation axis L2 (hereinafter referred to as an axis L2). In this embodiment, the coupling member 86 is connected to the end of the drum cylinder 62 such that the axis L1 of the drum cylinder 62 and the axis L2 of the coupling member 86 are substantially coaxial. Therefore, in the following explanation, the axis L1 and the axis L2 may be described as the same.

Here, the coupling member 86 is structured to be capable of advancing and retracting along the axis L2 relative to the drum cylinder 62 and to the drive side flange 87. In other words, the coupling member 86 can move substantially in parallel with the direction (axial direction) in which at least the axis (L2) extends. The coupling member 86 is capable of taking a position (projecting position, advancing position, first position) that is advanced (projecting) toward the outside of the driving side flange 87 and a position (retracted position, second position) retracted toward the inside (toward the drum cylinder) of the driving side flange 87. In other words, the coupling member 86 can reciprocate along the axial direction between the projecting position and the retracted position. Details will be described hereinafter with reference to Figures parts (b1)-(b4) of FIG. 7.

As shown in FIGS. 2 and 3, the developing unit 20 includes a toner accommodating container 22, a bottom member 21, a first side member 26L (non-driving side), a second side member 26R (driving side), a developing blade 42, a developing roller 32, and a magnet roller 34. Here, the toner accommodating container 22 contains a feeding screw 43 (stirring sheet) as a feeding member for feeding toner, and contains a toner T as a developer. In addition, the developing unit 20 is provided with a compression spring 46 that applies an urging force to regulate the attitude of the unit between the developing unit 20 and the cleaning unit 60.

Furthermore, the cleaning unit 60 and the developing unit 20 are rotatably connected with each other by the connecting pin 75 as a connecting member to constitute the cartridge B.

Specifically, rotation holes 23*b*L, 23*b*R are provided at free ends of the arm portions 23*a*L, 23*a*R provided at opposite ends of the developing unit 20 with respect to the longitudinal direction (the axial direction of the developing roller 32). The rotation holes 23*b*L and 23*b*R are extended parallel to the axis of the developing roller 32.

In addition, a fitting hole 71*a* for fitting the connecting pin 75 is provided at each of the longitudinal end portions of the cleaning frame 71 which is the frame of the cleaning unit 60. Then, while aligning the arm portions 23*a*L, 23*a*R with the predetermined position of the cleaning frame 71, the connecting pin 75 is inserted into the rotating holes 23*b*L, 23*b*R and the fitting hole 71*a*. By this, the cleaning unit 60 and the developing unit 20 are coupled with each other rotatably around the connecting pin 75 as the connecting member.

At this time, the compression spring 46 provided on the base of the arm portions 23*a*L, 23*a*R abuts to the cleaning frame 71, so that the developing unit 20 is urged toward the cleaning unit 60 with the connecting pin 75 as the center of rotation.

By this, the developing roller 32 as the process means is assuredly urged toward the drum cylinder 62 as a rotatable member. The developing roller 32 is kept at a predetermined distance from the drum cylinder 62 by a spacer (not shown) as a ring-shaped distance maintaining member mounted to the opposite end portions of the developing roller 32.

(Mounting and Dismounting of Process Cartridge)

Referring to FIGS. 4 and 5, the operation in which the cartridge B is mounted to and dismounted from the apparatus main assembly A in the foregoing structure will be described.

FIG. 4 illustrates how the cartridge B is mounted to and dismounted from the apparatus main assembly A. Part (a) of FIG. 4 is a perspective view as viewed from the non-drive side, and Fig. Part (b) of FIG. 4 is a perspective view as viewed from the drive side. The driving side is the end portion, in the longitudinal direction of the cartridge B, in which the coupling member 86 is provided.

The opening/closing door 13 is rotatably mounted to the main assembly A of the apparatus. FIG. 4 shows the main assembly A of the apparatus in a state in which the opening/closing door 13 is opened.

An opening O1 is provided in the apparatus main assembly A, and a mounting space for mounting the cartridge B is provided inside the apparatus main assembly A. A drive head (driving shaft, drive transmission member) 14 and a guide member 12 as a guide mechanism are provided inside the main assembly A of the device.

Here, the drive head 14 is a main assembly side drive transmission mechanism which is provided in the side of the main assembly A of the apparatus and transmits the driving force to the cartridge B mounted in the apparatus main assembly A, and is engageable with the coupling member 86 of the cartridge B. After the engagement, by rotation of the drive head 14, the rotational force can be transmitted to the cartridge B. Here, the drive head 14 is supported by the apparatus main assembly A so as to be rotatable about the axis L4. In addition, the drive head 14 is provided with a drive pin 14*b* as an imparting portion for applying a rotational force (see FIG. 7).

The guide member 12 as a guide mechanism is a main assembly side guide member for guiding the cartridge B into the main assembly A of the apparatus. The guide member 12 may be a plate-shaped member provided with a guide groove. The upper end of the guide member 12 may be contacted to the lower surface of the cartridge B to support the cartridge B from below and to guide (guide) the mounting and dismounting of the cartridge B.

Referring to FIG. 5 and FIG. 6, a structure for transmitting the rotational force inputted from the drive head 14 to the cartridge B to the drum cylinder 62 will be described. FIG. 5 is an illustration of a coupling member 86 as a driving force transmitting part, in which part (a) of FIG. 5 and part (b) of FIG. 5 are side views, and part (c) of FIG. 5 is a perspective view.

Part (a) of FIG. 6 and part (b) of FIG. 6 are illustrations of the drum gear unit U2 including the coupling member 86, part (a) of FIG. 6 and part (c) of FIG. 6 are perspective views, and part (c1) of FIG. 6 is a cross-sectional view taken along a s1 plane shown in parts (a) and (c) of FIG. 6. The coupling member 86 is provided movably in the drum unit U1, and part (a) of FIG. 6 and part (c) of FIG. 6 show different positions of the coupling member 86 in the drum unit U1.

As shown in FIG. 5, the coupling member 86 includes a supported portion 86*a*, a rotational force transmitting portion 86*b*, and a coupling portion 86*c*. First, the supported portion 86*a* has a cylindrical shape with the rotation axis L1 of the coupling member 86 as its central axis. Next, the rotational force transmission portion 86*b* includes a cylindrical imparting portion 86*b*1 projecting in a direction perpendicular to the rotation axis L1, a large diameter portion 86*b*4 including a cylindrical shape larger in diameter than the supported portion 86*a* and a shaft portion 86*b*3 connecting the large diameter portion 86*b*4 and the coupling portion 86*c*. There is a stepped portion 86*b*2 between the large diameter portion 86*b*4 and the supported portion 86*a*. The connecting portion 86*c* includes a base portion 86*c*3 having a spherical outer shape, a pair of projecting portions (projection) 86*c*1 projecting from the base portion 86*c*3 outwardly from the rotation axis L1, and a recessed portion 86*c*4 of spherical surface concentric with the base portion 86*c*3 formed by hollowing the base portion 86*c*3.

The connecting portion 86*c* is a portion for coupling (coupling) with the drive head 14 provided in the main assembly. The pair of projections 86*c*1 provided on the coupling portion 86*c* abuts the drive pin 14*b* of the drive head 14, to receive the rotational force (drive force) from the drive head 14. The contact portion of the projecting portion 86*c*1 in contact with the driving pin 14*b* is a force receiving portion (rotational force receiving portion, driving force receiving portion) for receiving rotational force. The coupling member 86 and the drum cylinder 62 are rotated by the rotational force received by the projecting portion 86*c*1.

The recess 86*c*4 is a surface formed by recessing the base 86*c*3 and faces the side opposite to the supported part 86*a* (that is, the free end side of the coupling member 86). The projection 86*c*1 projects from the surface in the neighborhood of the recess 86*c*4. Specifically, the base portion 86*c*3 has an annular surface (edge) around the recess 86*c*4, and the projecting portion 86*c*1 projects from the annular edge. The coupling member 86 has a plurality of projections 86*c*1 (two in this embodiment).

The projecting portion 86*c*1 projects away from the drum cylinder 62 in the direction of the axis L1 (axis L2). In other words, the projecting portion 86*c*1 projects toward the tip of the coupling member 86. The coupling member 86 is remotest away from the drum cylinder 62 in the direction of the axis L1 at the tip of the projecting portion 86*c*1.

The base portion 86*c*3 forms the end portion (first end portion) of the coupling member 86. The projecting portion

86*c*1 projects further from the base portion 86*c*3 toward the tip of the coupling member 86.

Further, the supported portion 86*a* and the large-diameter portion 86*b*4 are disposed inside the drum unit and are connected and fixed to a driving-side flange 87 which will be described hereinafter. In other words, the supported portion 86*a* and the large diameter portion 86*b*4 form a fixed end (second end portion) connected to the driving side flange 87.

The shaft portion 86*b*3 is a connecting portion connecting the first end portion and the second end portion of the coupling member. The distance from the axis L2 of the coupling member 86 to the surface of the shaft portion 86*b* (that is, the radius of the shaft portion 86*b*) is shorter than the distance from the projecting portion 86*c*1 to the axis. The distance between the projecting portion 86*c*1 and the axis L2 differs depending on the position of the projecting portion 86*c*1 but both the shortest distance and the longest distance from the projecting portion 86*c* to the axis L2 are longer than the distance from the axis L2 to the surface of the shaft portion 86*b*.

The two projecting portions 86*c*1 are inclined at an angle θ1 and an angle θ2 relative to the rotation axis L1. And, angles θ1 and θ2 are substantially equal.

That is, the pair of projections 86*c*1 has a conical shape with the rotation axis L1 as the central axis and has a line inclined from the rotation axis L1 by the angle θ1 as a generating line. In other words, the projecting portion 86*c*1 of the coupling portion 86*c* has such a shape that a distance from the rotation axis L2 increases toward the tip of the coupling member 86 (the tip of the projecting portion 86*c*1) (that is, as being away from the drum cylinder 62).

The projection (projection) 86*c*1 has an inner surface facing the axis L2 and an outer surface facing away from the axis L2. Both the inner surface and the outer surface of the projection 86*c*1 are structured to increase the distance from the axis L2 toward the tip of the projecting portion 86*c*1.

In other words, the projecting portion (projection) 86*c*1 has an outer surface that is more distant from the axis L2 as it is away from the drum cylinder 62 in the direction of the axis L2 (axis L1). The projecting portion (projection) 86*c*1 has an inner surface which increases the distance from the axis L2 as it is away from the drum cylinder 62 along the direction of the axis L2 (axis L1). The inner and outer surfaces of the projecting portion 86*c*1 have maxim distances from the axis L2 at the tip of the projecting portion.

Referring to FIG. 6, the drum gear unit U2 in which the coupling member 86 is incorporated will be described. As shown in FIG. 6, the drum gear unit U2 comprises the coupling member 86, the drive side flange 87, a lid member 88, and a compression spring 89.

The driving side flange 87 is a flange (drum flange) fixed to an end portion on the drive side of the drum cylinder 62, and has a gear on the outer circumference thereof. Therefore, sometimes the drive side flange 87 is called a drum gear. The gear on the drive side flange 87 engages with the gear provided at the end of the developing roller 32 (FIG. 32), so that when the drum cylinder 62 rotates, the driving force is transmitted to the developing roller 32.

The coupling member 86 is provided so that at least the rotational force transmitting portion 86*b*1 is accommodated in the hollow portion 87*a* of the driving side flange (drum gear) 87, and at least a part of the coupling portion 86*c* is projected outwardly beyond a driving side flange 87. The lid member 88 is fixed to the driving side flange 87 by adhering the bonding surface 88*d* to the surface 87*c* of the driving side flange 87, and the supporting portion 88*a* supports the supported portion 86*a* of the coupling member 86 so as to be movable in the direction of the rotation axis L1.

By this, the coupling member 86 can move in the direction of the rotation axis L1 (the direction of the arrow X4 and the direction of the arrow X5) in the drum gear unit U2. Here, the coupling member 86 is prevented from disengaging in the direction of the arrow X5 by the abutment of the stepped portion 86*b*2 and the free end portion 88*c* of the support portion 88*a*, and the coupling member 86 is prevented from disengaging in the direction of the arrow X4 by the abutment between the rotational force transmitting portion 86*b*1 and the retaining portion 87*b* of the drive side flange 87. A compression spring 89 is provided between the rotational force transmission portion 86*b*1 of the coupling member 86 and the spring receiving portion 88*b* of the lid member 88. By this, the coupling member 86 is urged in the direction (the arrow X4 direction) in which the coupling portion 86*c* projects from the driving side flange 87.

When the rotational force is transmitted to the coupling member 86, the rotational force transmission portion 86*b*1 comes into contact with the rotational force receiving portion 87*d*1 of the drive-side flange 87 to transmit the rotational force to the drive-side flange 87. Press-fit portion 87*e* of the drive side flange 87 is press-fitted and fixed to the inner diameter portion of the drum cylinder 62 (see FIG. 3). With this structure described above, the rotational force is transmitted from the drive head 14 to the drum cylinder 62. The coupling member 86 is connected to the end of the drum cylinder 62 by the way of the driving side flange 87, and the coupling member 86 and the drum cylinder 62 are interlocked with each other. The way of connecting the coupling member and drum cylinder 62 is merely an example. It will suffice if the drum cylinder 62 can be rotated by the rotation of the coupling member 86.

Then, referring to FIG. 7, the operation of the coupling member 86 when the cartridge B is dismounted from the apparatus main assembly A will be described. FIG. 7 is an illustration of the dismounting operation of the drum unit U2, in which the main assembly A is shown only by the drive head 14 and the coupling guide (guide member 15). The drum gear unit U2 of the cartridge B sequentially escapes from FIG. 7 (a1) to (a4), and FIG. 7 (a1) shows the state in which driving of the apparatus main assembly A is completed. Part (b1) of FIG. 7 to part (b4) thereof are cross-sectional views (S2 cross-sectional view) of the structures shown in part (a1) of FIG. 7 to part (a4) thereof, taken along the line S2-S2. For the sake of illustration, the drive head 14 is shown without cross-section.

The guide member 15 is provided in the neighborhood of the drive head 14 to guide the coupling member. The guide member 15 is disposed behind the drive head 14 when viewing the interior of the apparatus main assembly A through the opening O1 (see FIG. 4) of the apparatus main assembly A.

As shown in part (a1) of FIG. 7 and part (b1) of FIG. 7, when the coupling member 86 is positioned in the projecting position, the coupling member 86 is engaged (coupled) with the drive head 14. When the cartridge B is moved in the direction of the arrow X3 after the completion of the rotation of the drive head 14, the coupling member 86 moves in the direction of the arrow X3 together with the drum gear unit U2. At the same time, the upstream side of the coupling member 86 in the dismounting direction of the cartridge B is brought into contact with the drive head 14. In other words, the inner surface of the recess 86*c*4 or the projection 86*c*1 is brought into contact with the drive head 14. This causes the coupling member 86 to move in the direction of the arrow X5 (see part (a2) of FIG. 7 and part (b2) thereof).

In this embodiment, both the contact portions of the drive head 14 and the coupling member 86 are inclined relative to the axis L1 and the axis L4 (see parts (b1) to (b4) of FIG. 7). that is, the free end of the driving head 14 is inclined relative to the axis L4 of the driving head 14. In addition, the surfaces of the recess 86*c*4 of the coupling member and the projecting portion 86*c*1 are also inclined relative to the axis L1 (axis L2).

Therefore, when the cartridge B is moved in the X3 direction with the drive head 14 and the coupling member 86 in contact, the force F1 received by the coupling head 86 from the drive head 14 has the component in the direction of the arrow X5 (component in the axial direction). By this, the coupling member 86 is retracted in the direction of the arrow X5 (toward the drum cylinder) by the force F1 received from the contact portion to the drive head 14.

However, it will suffice if at least one of the contact portion between the driving head 14 and the inner surface of the coupling member 86 and the driving head 14 is inclined relative to the axis L2 of the coupling member 86. In this case, the force F1 received by the coupling member 86 has a component for moving the coupling member 86 in the direction of the arrow X5.

In this embodiment, the inner surface of the projecting portion 86*c*1 facing the axis L2 is structured such that the distance from the axis L2 increases as the entirety thereof moves away from the drum cylinder 62 in the direction of the axis L1. However, it is unnecessary for the entire projecting portion 86*c*1 to have such a structure. At least a part of the inner surface of the projecting portion 86*c*1, that is, it will suffice if at least a portion that is in contact with the driving head 14 has the above-mentioned inclination. If so, when the inner surface of the projecting portion 86*c*1 comes into contact with the driving head 14, the coupling member 86 is easily retracted toward the drum cylinder along the direction of the axis L2.

When the cartridge B is further moved in the direction of the arrow X3 from the state shown in part (a2) of FIG. 7 and part (b2) thereof, the coupling member 86 further moves in the direction of the arrow X5. The coupling member 86 finally becomes in the state shown in part (a4) of FIG. 7, part (b4) thereof through the state shown in part (a3) of FIG. 7, part (b3) thereof. At this time, the free end portion 86*c*12 of the projecting portion 86*c*1 does not overlap the driving head 14 in the direction of the rotation axis L1. By this, the coupling member 86 can circumvent the drive head 14, and the cartridge B can be pulled out of the apparatus main assembly A.

In this embodiment, the coupling member 86 is structured to move substantially in parallel with the axis L1 of the drum cylinder 62. The coupling member 86 moves along the axis L2 while keeping the axis L2 of the coupling member 86 coaxial with the axis L1 of the drum cylinder 62 (that is, keeping the state in which the axis L1 and the axis L2 overlap with each other).

However, the coupling member 86 may move in a direction inclined relative to the axis L1, that is, the axis L2 may not overlap with the axis L1. For example, if the coupling member 86 moves along the axis L2, the movement direction thereof may not necessarily be parallel to the axis L1. In this case, the angle of the axis L2 relative to the axis L1 is substantially constant before and after the coupling member 86 moves along the axis L2.

In this embodiment, the coupling member 86 moves along the axis L2 while maintaining the state in which the angle of the axis L2 relative to the axis L1 is substantially 0 degree.

As described above, the projecting portion 86*c*1 is formed such that the distance from the axial line L2 is increased as the distance from the drum cylinder 62 increases in the direction of the axis L1. In other words, the distance from the axis L2 becomes larger toward the tip of the projecting portion 86*c*1, that is, the projecting portion 86*c*1 expands in the radial direction of the coupling member 86 toward the there is provided thereof.

Therefore, as shown in FIG. 7(*b*), the projecting portion 86*c*1 has a small diameter on the rear end side (root side), so that in the state that the coupling portion 86*c* is in contact with the drive head 14, a large distance can be assured between the outer surface of the projecting portion 86*c*1 and the guide portion 15*a* of the member 15. By this, the coupling member 86 can move without the joint portion 86*c* contacting to the driving head 14 and to the guide member 15 at the same time. That is, when the coupling member 86 moves in the direction of the arrow X5, the movement of the coupling member 86 is not hindered by the guide member 15. In other words, the engagement between the coupling member 86 and the drive head 14 can be smoothly released, and the load applied to the user when extracting the cartridge B out of the apparatus main assembly A can be reduced.

Here, the guide portion 15*a* is an inclined portion inclined relative the axis L4 of the drive head 14 and is inclined in the direction of the facing the drive head 14*g*. Since the guide portion 15*a* is inclined relative to the axis L4, the guide member 15 protrudes so as to approach the axis L4, and the projecting portion faces the shaft portion 86*b*3 (see FIG. 5) of the coupling member 86. As shown in FIG. 5, the shaft portion 86*b*3 of the coupling member 86 has a smaller diameter than the projecting portion 86*c*1 and the base portion 86*c*3, so that it can be avoided that the protruding portion of the guide member 15 contacts the coupling member 86.

As described above, according to this embodiment, the projecting portion 86*c*1 expands radially outward as it goes away from the drum flange 62 in the direction of the axis L1 (that is, as it goes toward the tip (free end) of the coupling member 86). Therefore, even though the guide member 15 is provided in the main assembly of the apparatus, the coupling member 86 can be retracted smoothly from the drive head 14 when taking the cartridge B out of the apparatus main assembly A.

It is not necessary that the whole of the projecting portion 86*c*1 has the above-mentioned shape, and it will suffice if the portion necessary for passing through the gap between the guide member 15 and the driving head 14 has the above-mentioned shape.

That is, at least a part of the projecting portion 86*c*1 may be structured to increase the distance from the axis L2 as the distance from the drum flange 62 increases in the direction of the axis L1.

In this embodiment, the coupling member 86 is formed so as not to contact the guide member 15 when the coupling member 86 is retracted while being in contact with the drive head 14. However, even if the coupling member 86 is upsized, it is also possible to employ a structure in which it simultaneously comes into contact with the drive head 14 and the guide member 15 when the coupling member 86 retracts. For example, even if the coupling member 86 contacts with the drive head 14 and with the guide member 15 at the same time, if the guide member 15 is elastically deformed, for example, the load at the time when the coupling member 86 is retracted in the direction of the arrow X5 is not so large. The inner surface of the projecting portion 86*c*1 is inclined so as to be along the tip of the driving head 14 and the outer surface of the projecting portion 86*c*1 is inclined along the guide member 15. Therefore, the coupling member 86 can be moved to the retracted position, while the outer surface of the projecting portion 86*c*1 is guided by the guide member 15 and the inner surface of the projecting portion 86*c*1 is guided by the driving head 14. The coupling member 86 can smoothly disengage from the drive head 14.

In other words, if the load on the user at the time when dismounting the cartridge B is within the allowable range, the wall thickness of the coupling portion 86*c* may be increased and the coupling member 86 may be contacting with the guide member 15 when the coupling member 86 is retracted.

Increasing the wall thickness of the coupling portion 86*c* can improve the strength of the coupling portion 86*c*, so that the rotation accuracy of the drum cylinder 62 can be improved.

In this embodiment, the projecting portion 86*c*1 projects from the base portion 86*c*3 provided in the coupling portion 86*c*, but, as shown in parts (a)-(c) of FIG. 8, a pair of projecting portions 186*c*1 may be projected from the shaft portion 186*b*3.

In this case, the projecting portion 186*c*1 which is a rotational force receiving portion (driving force receiving portion) has a shape expanding outward in the radial direction of the coupling member 186 as going toward the tip thereof.

Referring to FIG. 24, the operation of the coupling member 86 when mounting the cartridge B in this embodiment will be described. Part (a) of FIG. 24, part (b) of FIG. 24 and part (c) of FIG. 24 illustrate the coupling member 86. Part (d) of FIG. 24, part (e) thereof, and part (0 thereof are cross-sectional views of the coupling member 86.

Part (d) of FIG. 24, part (e) thereof, and part (0 thereof are cross-sectional views corresponding to part (a) of FIG. 24, part (b) thereof and part (c) thereof, respectively.

In this embodiment, if the coupling member 86 (drum cylinder 62) is not at a predetermined phase, the cartridge B cannot be mounted in the apparatus main assembly A or it is difficult to mount it. In other words, if the coupling member 86 has the phase shown in part (a) of FIG. 24 and part (d) of FIG. 24, the outer surface of the projecting portion 86*c*1 (coupling portion 86*c*) of the coupling member 86 collides against the driving head 14 of the apparatus main assembly A. In such a case, the cartridge B cannot be mounted, or it is difficult to mount.

On the other hand, in the case of the phases shown in part (b) of FIG. 24 and part (e) of FIG. 24 when the cartridge B is mounted, the projecting portion 86*c*1 of the coupling member 86 does not contact the driving head 14. On the other hand, the base portion 86*c*3 of the coupling member 86 contacts the drive head 14. However, when the base portion 86*c*3 comes into contact with the inclined portion (curved surface portion) provided at the tip of the drive head 14, the coupling member 86 retracts in the axial direction. Therefore, mounting of cartridge B is not hindered. Finally, the state shown in part (c) of FIG. 24 and part (f) of FIG. 24 is established, and the axis of the coupling member 86 and the axis of the drive head 14 become substantially coaxial with each other. The coupling member 86 is engageable with the drive head 14 and becomes capable of receiving the driving force (rotational force) from the drive head 14.

On the other hand, in the state shown in part (a) of FIG. 24 and part (d) of FIG. 24, the user may not be able to mount the cartridge B in the apparatus main assembly A in some cases. In such a case, it is necessary to take the cartridge B out of the apparatus main assembly A and rotate the coupling member 86 until the state shown in FIG. 24 (*b*) and part (d) thereof is reached. Therefore, it is desirable to shorten the width of the projecting portion 86*c*1 so that the projecting portion 86*c*1 does not collide against the driving head 14 when mounting the cartridge B in as many cases as possible.

On the circumference of the base portion 86*c*, a region 86*c*11 where the projecting portion 86*c*1 exists is longer than a region where the projecting portion 86*c*1 does not exist provided. In other words, the sum of the widths of the two projecting portions 86*c*1 is less than half of the circumferential length of the base portion 86*c*.

As shown in part (a) of FIG. 25 and part (b) of FIG. 25, an inclined portion 86*c*5 may be provided at the tip of the base portion 86*c*3 so that the coupling member 86 is easily retracted when it comes into contact with the drive head 14.

The inclined portion 86*c*5 is inclined relative to the axis of the coupling member 86. Therefore, when the inclined portion 86*c*5 contacts with the drive head 14, the coupling member 86 receives a force in the axial direction. This force is effective to retract the coupling member 86 in the axial direction.

If at least one of the contact portions of the coupling member 86 and the drive head 14 is inclined relative to the axis of the coupling member 86, the coupling member 86 can retract in the axial direction by receiving the force in the axial direction.

Embodiment 2

Embodiment 2 of the present invention will be described referring to FIGS. 9 to 13.

In the description of this embodiment, the same reference numerals as in Embodiment 1 are assigned to the elements having the corresponding functions in this embodiment, and the detailed description thereof is omitted.

Referring first to FIG. 9, the structure of the drum gear unit U23 will be described FIG. 9 is an illustration of the structure of the drum gear unit U23, which is an exploded perspective view shown in the order of assembling from part (a) of FIG. 9 to (e).

Part (a) of FIG. 9 and part (b) of FIG. 9 are exploded views of the first unit U21. The first unit U21 comprises a coupling member 286, a translating cam 288, and a rotating cam 289. A supported portion 286*a* of the coupling member 286 is assembled so as to penetrate the hole portion 288*a* of a translating cam 288 and a hollow portion 289*a* of the rotating cam 289.

On the coupling member 286, a pressed portion 286*b* is provided between a shaft portion 286*a* and a coupling portion 286*c*. The translating cam 288 includes a cylindrical surface 288*b*, a projecting portion 288*c* projecting radially outward from the cylindrical surface 288*b*, a cut-away portion 288*d* provided by cutting a part of the cylindrical surface 288*b* away, and a pressing portion 288*e*.

The rotating cam 289 has a hollow portion 289*a*, a cut-away portion 289*c*, an outer shape portion 289*b*, and a projecting portion 289*d*. The hollow portion 289*a* accommodates the translating cam 288 and the coupling member 286 and rotatably supports the cylindrical surface 288*b*.

In addition, the cut-away portion 289*c* is formed so as to cut out a part of the hollow portion 289*a*, and accommodates the projecting portion 288*c*. Here, the cut-away portion 289*c* is provided with a slanted surface portion 289*c*1, and the projecting portion 288*c* opposed thereto is also provided with a slanted surface portion 288*c*1.

FIG. 9 (*c*) is an exploded view of a second unit U22. The second unit U22 comprises a first unit U21, an auxiliary member 290, and a pin 291. The coupling member 286 of the first unit U21 is assembled so that the shaft portion 286*a* penetrates a hole 290*a* of the auxiliary member 290. Thereafter, the pin 291 is inserted so as to penetrate a lateral hole portion 290*b* of the auxiliary member 290 and a hole portion 286*d* of the coupling member 286.

FIG. 9 (*d*) is an exploded view of the drum gear unit U23. The drum gear unit U23 comprises the second unit U22, a driving side flange (drum gear 287), a compression spring 292, and a cover member 294. The drum gear 287 accommodates the second unit U22 in an inside 287*a*, the shaft portion 286*a* of the coupling member 287 penetrates a hole (not shown) of the drum gear 287 and projects out toward the cover member 294 (in the direction of the arrow X5). Here, the second unit U22 is inserted so that the pin 291 is in transmitted portion 287*b* of the hollow portion 287. The shaft portion 286*a* further penetrates an inner diameter portion 292*a* of the compression spring 292, and the cover member 294 is fixed to the free end. The compression spring 294 abuts a spring abutment portion 294*b* of the cover member 294 and a spring abutment portion (not shown) of the drum gear 287.

As shown in FIG. 9 (*e*), the drum gear unit U23 assembled in such a manner that the projecting portion 289*d* of the rotating cam 289 projects from the drum gear 287 in the arrow X4 direction. In this state, the compression spring 292 is compressed and urges the coupling member 286 together with the cover member 294 move in the direction of the arrow X5 with respect to the drum gear 287.

The rotational force transmitted to the coupling member 286 is transmitted to the driving side flange (the drum gear 287) by way of the pin 291 and the transmitted portion 287*b* of the drum gear 287.

Referring to FIG. 10, the structure of the cleaning unit 61 will be described. The drum gear unit U23 is fixed to one end of the drum cylinder 62. The drum gear unit U23 and drum cylinder 62 constitute drum unit U12. The drum unit U12 is disposed in a cleaning frame 71 and is rotatably supported in the cleaning unit 61 by a bearing 293. The supporting portion 293*a* of the bearing 293 rotatably supports the outer shape portion 289*b* of the rotating cam 289. In addition, a stopper 293*b* is assembled so as to enter the cut-away portion 288*d* of the translating cam 288. By this, the rotation cam 289 is rotatable relative to the bearing 293, and the translation cam 288 is non-rotatable relative to the bearing 293.

Referring to FIG. 11, the structure of a developing unit 21 and a cartridge B will be described. The developing unit 21 is connected to the cleaning unit 61 as in the Embodiment 1. In addition to this, a lever member 297 is further connected to the developing unit 21 and the cleaning unit 61.

The lever member 297 is provided on a second side member 226R of the cartridge B and extends in a direction away from the drum cylinder toward the tip of the lever member 297. In other words, the tip of the lever member 297 projects away from the second side member 226R.

The second side member 226R is a part of the frame of the cartridge B and forms the side surface of the cartridge B. That is, the second side member 226R is provided at the end of the cartridge B in the direction of the axis L1 of the drum cylinder 62.

The lever member 297 is provided with a projection 297*a*, an elongated hole portion 297*b*, and a bent portion 297*c*. The elongated hole portion 297*b* is connected with the second side member 226R by the fixing member 295, and is held so as to be movable along the long axis direction of the long round hole relative to the second side member 226R, and rotatable about fixed the member 295. A lever spring (compression spring) is provided between the spring abutment portion 297*c*1 of the bent portion 297*c* and the second side member 226R to urge the lever member 297 in the direction of the arrow X3. A pressed portion 297*c*2 of the bent portion 297*c* is a portion to be pushed by the cartridge pushing portion (not shown) of the opening/closing door 13 when the cartridge B is mounted to the apparatus main assembly A and the opening/closing door 13 of the apparatus main assembly A is closed. The projection 297*a* is inserted into a hole 289*d*1 formed in the projection 289*d* of the rotating cam 289.

Referring to FIG. 12, the operation of the lever member 297 and the drum gear unit U23 will be described. Part (a) of FIG. 12 and part (b) of FIG. 12 are illustrations of the operation of the lever member 297, and part (c) and (d) thereof is an illustration of the operation of the drum gear unit U23.

The lever member 297 and the coupling member 286 are structured so as to move in interrelation with the opening and closing operation of the opening/closing door 13 (see FIG. 4). FIG. 12 (*a*) shows a state in which the cartridge B is mounted in the apparatus main assembly and the opening/closing door 13 is opened. When the opening/closing door 13 is closed from this state, as shown in FIG. 12 (*b*), the pressed portion 297*c* of the lever member 297 is pushed in the direction of the arrow X6 by a cartridge pushing portion (not shown) of the opening/closing door 13. Then, the lever member 297 moves in the right direction in FIG. 12 (*b*) along the long axis direction of the elongated hole portion 297*b*. As the lever member 297 moves, the projection 297*a* rotates the rotating cam 289 in the direction of the arrow R3 by way of the hole 289*d*1 of the rotating cam 289.

That is, when the rotating cam 289 rotates from the state shown in FIG. 12 (*c*), the state shown in FIG. 12 (*d*) is established. When the rotating cam 289 rotates by the movement of the lever member 297, the slope portion 289*c*1 comes into contact with the projecting portion 288*c* of the translating cam 288 as shown in FIG. 12 (*d*). At this time, since the translating cam 288 cannot rotate relative to the bearing 293 as described above, in order to avoid interference with the slope portion 289*c*1, the projection 288*c* ascends the slope portion 289*c*1 to move in the direction of the arrow X4 (outward in the axial direction).

The translation cam 288 pushes the coupling member 286 when moving in the direction of the arrow X4. Therefore, the coupling member 288 also moves in the direction of the arrow X4. More specifically, the pressing portion 288*e* of the translating cam 288 pushes the pressed portion 286*b* of the coupling member 286 to apply a force in the direction of the arrow X4, so that the coupling member 286 moves in the direction of the arrow X4.

That is, when the opening/closing door 13 (see FIG. 4) is closed, the coupling member 286 advances in a direction approaching the drive head 14. By this, the coupling portion (driving force receiving portion) 286*c* provided on the coupling member 286 is enabled to engage with the drive head 14. In other words, the coupling portion 286*c* becomes in a state capable of receiving the rotational force (driving force) from the drive head 14.

The lever member 297 is an operation member operated by the opening/closing door 13.

Referring to parts (a1) to (a4) of FIG. 13 and parts (b1) to (b4) of FIG. 13, the movement of the drum gear unit U23

(coupling member 286) will be explained. Figures show the process of mounting the cartridge B in the main assembly A and the process of closing the door 13 after mounting the cartridge B.

In FIG. 13, for the apparatus main assembly A, only the drive head 14 and the guide member 15 are shown.

In the process of mounting the cartridge B in the apparatus main assembly A, the coupling member 286 moves in the right direction (the direction of the arrow X2) in part (a1) of FIG. 13 and part (b1) of FIG. 13. At this time, the tip 286*c*12 of the coupling member 286 is located approximately at the same position as the tip of the drive head 14.

As shown in part (a2) of FIG. 13 and part (b2) of FIG. 13, on the way of mounting the cartridge B, the downstream side of the coupling member 286 in the mounting direction contacts the guide member 15. More specifically, the projecting portion 286*c*1 of the coupling member 286 contacts the guide portion 15*a* of the guide member 15. In this state, the cartridge B is further inserted into the apparatus main assembly A, by which the coupling member 286 moves in the right direction. Then, the projecting portion 286*c*1 receives a force from the guide portion 15*a*, so that the coupling member 286 moves in the direction of the arrow X4 in FIG. 13 (b2), into the state shown in part (a3) of FIG. 13, part (b3) thereof.

That is, the projecting portion 286*c*1 and the guide portion 15*a* are inclined with respect to the axis L1 of the coupling member 286. Therefore, when the projecting portion 286*c*1 and the guide portion 15*a* come into contact, the force received by the projecting portion 286*c*1 from the guide portion 15*a* has a component in the direction along the axis L1. In other words, the force received by the projecting portion 286*c*1 from the guide portion 15*a* has an upward component in FIG. 13 (b2). By this force, the coupling member 286 moves upward in FIG. 13 (b2) with the mounting operation of the cartridge B into the state of FIG. 13 (a3), part (b3) thereof. Part (a3) of FIG. 13 and part (b3) thereof show a state where the cartridge B is completely loaded in the apparatus main assembly A, but the opening and closing door 13 (see FIG. 4) is still open. At this time, the axis L2 of the coupling member 286, the axis L1 of the drum cylinder, and the axis L4 of the drive head 14 are substantially coaxial with each other.

When the opening/closing door 13 is closed from the state shown in part (a3) of FIG. 13 and part (b3) thereof, the rotating cam 289 rotates in the clockwise direction (arrow R3 direction) in FIG. 13 (a4) by the mechanism described above. By this, the coupling member 286 further advances toward the drive head 14. By this, the coupling member 286 is brought into a state of capable of engaging with the drive head 14 to receive the driving force from the drive head 14. In other words, when the drive head 14 rotates in this state, the drive pin 14*b* provided on the drive head 14 engages with the projection 286*c*1 of the coupling member 286 so that the drive is transmitted from the drive pin 14*b* to the coupling member 286. The contact portion of the projecting portion 286*c*1 in contact with the driving pin 14*b* is the rotational force receiving portion (force receiving portion, driving force receiving portion) which receives the rotational force from the driving pin 14*b*.

In this embodiment, the coupling member 286 is moved stepwise from the retracted position (second position) to the projecting position (first position) in the process until the cartridge B is mounted to the apparatus main assembly A and the opening/closing door 13 is closed. As the cartridge B moves to the inside of the apparatus main assembly A, the outer surface of the projecting portion 286*c*1 is guided by the guide portion 15*a*, so that the coupling member 286 slightly approaches the projecting position from the retracted position (parts (a3), (b3) of FIG. 13). thereafter, when the opening/closing door 13 is closed, the coupling member 286 completely moves to the projecting position in interrelation with the movement of the lever member 297, so that the coupling member 286 can be coupled with the driving head 14 (parts (a4) and (b4) of FIG. 13).

However, in the course of movement of the cartridge B to the inside of the apparatus main assembly A, the outer surface of the projecting portion 286*c*1 does not necessarily need to contact the guide portion 15*a*, and the coupling member 286 does not need to move in the direction of the axis L2. Another structure is possible in which at the time when the cartridge B is inserted into the main assembly A of the apparatus, the coupling member 286 does not contact the guide portion 15*a* and remains in the state of the retracted position. Even in such a case, the coupling member 286 is moved from the retracted position to the projecting position by the closing operation of the opening/closing door 13.

On the contrary to the case where the cartridge B is dismounted from the apparatus main assembly A, when dismounting the cartridge B from the apparatus main assembly A, the cartridge B performs the operation in reverse order of the above-described process. First, when the opening and closing door 13 is opened, the force in the X6 direction (see FIG. 12 (*b*)) to the lever member 297 becomes not applied, and the lever member 297 is moved in the direction of the arrow X3 (FIG. 11) by the urging force of the spring 296. Then, the rotating cam 289*d* rotates in the direction of the arrow R9 in FIG. 13 (a4), and the urging force of the compression spring 292 moves the coupling member 286 in the direction of the arrow X5 (part (a3) of FIG. 13, part (b3) thereof). As the cartridge B is further pulled out, the coupling member 286 further moves in the direction of the arrow X5 by the urging force of the compression spring 292 (part (a2) of FIG. 13 and part (b2) thereof), and finally, the state shown in parts (a1) and (b1) of FIG. 13 is established. By this, the cartridge B can be removed from the main assembly A of the apparatus.

When dismounting the cartridge B from the apparatus main assembly A, the upstream side of the coupling member 286 in the dismounting direction contacts with the guide portion 15*a*.

Also in this embodiment, as in the Embodiment 1, at least a part of the outer surface of the projecting portion 286*c*1 of the coupling member 286 is inclined relative to the axis L2.

The outer surface of the projecting portion 286*c*1 has such a shape that it expands in the radial direction of the coupling member 286 (increases the distance to the axis L2) as it goes toward the tip (free end) thereof. In other words, the rear end of the projecting portion 286*c*1 has a smaller diameter than the tip. Therefore, it is possible to assure a wide distance between the guide portion 15 and the coupling member 286 in the process of mounting and dismounting the cartridge B to and from the apparatus main assembly A (see part (b2) of FIG. 13 and part (b3) thereof). The projecting portion 286*c*1 of the coupling member 286 avoids interference with the guide member 15. Therefore, the coupling member 286 can smoothly perform the coupling and decoupling relative to the drive head 14.

That is, even when the outer surface of the projecting portion 286*c*1 comes into contact with the guide portion 15 at the time of mounting or dismounting the cartridge B, the projecting portion 286*c*1 is not prevented from moving by the guide portion 15 and is smoothly guided by the guide portion 15. This makes it easy to mount and dismount cartridge B.

The outer surface of the projecting portion 286*c*1 faces away from the axis L2 of the coupling member 286. In this embodiment, the distance from the axis L2 of the entire outer surface of the outer surface increases as it moves away from the drum cylinder 62 in the direction of the axis L1. In other words, the outer surface of the projecting portion 286*c*1 has the largest distance from the axis L2 at the tip of the projecting portion 286*c*.

However, it is not necessary that the entire outer surface of the projecting portion 286*c*1 has such a shape, but it will suffice if the portion necessary for the projecting portion 286*c* to pass through between the driving head 14 and the guide member 15 has the above-described shape. If will suffice if at least a part of the outer surface of the projecting portion 286*c*1, that is, at least a portion facing the guide portion 15 is structured so as to increase the distance from the axis L2 as moving away from the drum cylinder 62 in the direction of the axis L1.

Embodiment 3

Another embodiment will be described below referring to FIGS. 14 to 19. In this embodiment, the coupling member 386 advances and retracts along the axial direction by the rotation of the operating member (the lever 394).

Referring to FIG. 14, the structure of the drum gear unit U31 in this embodiment will be described.

Part (a) of FIG. 14 is an exploded perspective view of the structure of a drum gear unit U31, FIG. 14 (*b*) is a perspective view, part (c) of FIG. 14 and part (d) of FIG. 14 are sectional views taken along S4 plane and the S5 plane, respectively.

As shown in part (a) of FIG. 14 and part (c) of FIG. 14, the drum gear unit U31 comprises a driving side flange (drum gear 387), a coupling member 386, a cam 388, a lid member 389, a compression spring 390, and a pin 391. The coupling member 386 is assembled so that a shaft portion 386*a* penetrates a hole portion 388*a* of the cam 388, and then a pin 391 is inserted and fixed in a hole portion 386*d* of the coupling member 386. These parts are provided inside an inner cylindrical surface 387*an* of the drum gear 387, and thereafter the lid member 389 is fixed to the drum gear 387 with the compression spring 390 interposed therebetween. At this time, the compression spring 390 is sandwiched between the pin 391 and the lid member 389 in a compressed state as shown in FIG. 14 (*d*), and the pin 391 and the cam 388 are pushed outwardly (the direction of the arrow X4) of the drum gear 387. By this, as shown in FIG. 14 (*b*), a part of the slanted portion 388*e* of the cam 388 projects from the drum gear 387. The shaft portion 386*a* of the coupling member 386 is fitted and supported in the hole portion 388*a* of the cam 388, and the outer peripheral portion 388*c* of the cam 388 is fitted and supported to the inner cylindrical surface 387*a* of the drum gear 387. By this, the coupling member 386 is supported such that the rotational axis thereof and the rotational axis of the drum gear 387 are substantially parallel with each other. Furthermore, by assembling the pin 391 to enter the groove 387*b* of the drum gear 387, the rotational force of the coupling member 386 can be transmitted to the drum gear 387 by the way of the pin 391. Here, the cam 388 is merely in a fitting relationship with the coupling member 386 and the drum gear 387, 8*nd* therefore, they do not rotate integrally.

Referring to FIG. 15, the structure of the cleaning unit 61 in this embodiment will be described. FIG. 15 is a perspective view illustrating the structure of the cleaning unit 61.

As shown in FIG. 15, the drum gear unit U31 is integrally fixed to a drum cylinder 62 in the same manner as in the previous embodiment, and then assembled into the cleaning frame 71 using a bearing 393. The bearing 393 is provided with an abutting surface 393*b* on the upper side of the hole 393*a* through which the coupling member 386 penetrates, and is provided with a cut-away portion 393*c* on the side where the developing unit 21 (see FIG. 16) will be assembled later. The drum gear unit U31 is assembled with the cleaning frame 71 and the bearing 393 so that the abutted surface 388*d* of the cam 388 opposes the contact surface 393*b* of the bearing 393.

Referring to FIG. 16, a structure in which the cartridge B is assembled by combining the cleaning unit 61 and the developing unit 21 will be described. FIG. 16 (*a*) is an exploded perspective view of the cartridge B, and FIG. 16 (*b*) is a perspective view of the cartridge B, in which only the driving side is shown. Part (c) of FIG. 16 and part (d) of FIG. 16 are detailed views of the neighborhood of the bearing 393.

As shown in FIG. 16 (*a*), a lever member 394 is rotatably supported by a support member 395 on the drive side of the developing unit 21. Here, the support member 395 passes through a hole 394*a* of the lever member 394 and is fixed to a hole 326Ra of a first side member 326R. By this, the lever member 394 can rotate about the support member 395 and the hole 394*a* in the developing unit 21. The lever member 394 is provided with a first pressing portion 394*c* on the side where the cleaning unit 61 will be assembled later and a second pressing portion 394*b* on the opposite side across the hole portion 394*a*.

Part (b) of FIG. 16 to part (d) thereof, when the developing unit 21 and the cleaning unit 61 are coupled with each other, the first pushing portion 394*c* of the lever member 394 passes through the cut-away portion 393*c* of the bearing 393 to approach to the slope portion 388*e* of the cam 388. As shown in part (a) of FIG. 16 and part (b) of FIG. 16, the cleaning frame 71 is provided with a second boss 71*b* on the side opposite to the developing unit 21 as viewed from the drum cylinder 62.

Referring to FIG. 17, the operation of the lever member 394 and the drum gear unit U31 in this embodiment will be described FIG. 17 is an illustration of the operation of the lever member 394 and the drum gear unit U31. Part (a) of FIG. 17 and part (b) of FIG. 17 are perspective views, showing the state in which the positions of the lever members 394 are different from each other. FIG. 17 (*c*) is a sectional view of the state of FIG. 17 (*b*) taken along a plane S6, and for the sake of explanation, the coupling member 386 and the pin 391 are shown without sectioning. When the lever member 394 rotates in the direction R5 from the state shown in FIG. 17 (*a*) as shown in FIG. 17 (*b*), the first pressing portion 394*c* moves in a direction approaching the contact surface 393*b* so as to abut to and interfere with the inclined surface portion 388*e* of the cam 388. Then, the inclined surface portion 388*e* abuts to the first pressing portion 394*c* and the contacted surface 388*d* abuts to the contact surface 393*b* of the bearing 393, respectively, so that the cam 388 moves in the direction of an arrow X5 while being sandwiched between the first pressing portion 394*c* and the contact surface 393*b*. By this, the coupling member 386 also moves in the direction of the arrow X5 by way of the pin 391.

Referring to FIG. 18, the operation of the lever member 394 and the drum gear unit U31 when this cartridge B is mounted in the apparatus main assembly A will be described. FIG. 18 is an illustration of mounting the cartridge B in the apparatus main assembly A. Part (a1) of FIG. 18 and part (a3) thereof show state in the process of mounting, and FIG. 18 (a3) shows the state in which the mounting is completed.

Part (b1) of FIG. 18 to 18 (b3) are sectional views taken along a cutting line S7 of FIG. 18 (a1) to FIG. 18 (a3), and for the purpose of better illustration, some parts are shown not in sectional view. as shown in FIG. 18 (a1), when mounting the cartridge B in the apparatus main assembly A, the cartridge B is mounted while being rotated in the direction of the arrow R4. Then, the cartridge B can rotate until the second boss 71*c* comes into contact with the second guide lower surface portion 12*d* provided on the guide 12 of the apparatus main assembly A. At this time, the second pressing portion 394*b* of the lever member 394 abuts against the first guide upper surface portion 12*b* of the guide 12, and the lever member 394 rotates in the direction of the arrow R5 about the supporting member 395. Then, as described above, the coupling member 386 becomes in the stage having moved in the direction of the arrow X5 as shown in FIG. 18 (b1). As the cartridge B is going to be mounted in this state in the direction of the arrow X2, the projection 386*c*1 of the coupling member 386 passes through the drive head 14 and the coupling member 386 moves to the guide member 15 as shown in FIG. 18 (b2). Finally, as shown in FIG. 18 (a3), the cartridge B is rotated in the direction of the arrow R6 until the second boss 71*c* and the second guide upper surface portion 12*c* contact each other. Then, the coupling member 386 and the cam 388 move in the direction of the arrow X4 by the urging force of the compression spring 390, and at the same time, the lever member 394 rotates about the support member 395 in the direction of arrow R7 by the contact between the slanted portion 388*e* and the first push portion 394*c*. in this manner, the coupling member 386 moves in the direction of the arrow X4 and becomes engageable with the driving head 14, and the mounting of the cartridge B on the apparatus main assembly A is completed.

In this state, when the drive head 14 rotates, the drive pin of the drive head 14 contacts the projection 386*c*1, so that the rotational force is transmitted to the projection 386*c*1. The contact portion of the projecting portion 386*c*1 in contact with the driving pin is a force receiving portion for receiving the rotational force from the driving pin. The coupling member 386 and the drum cylinder 62 are rotated by the rotational force received by the projecting portion 386*c*1.

On the other hand, when taking the cartridge B out of the apparatus main assembly A, the coupling member 386 and the lever 394 operate in the direction opposite to that when the cartridge B is mounted. the coupling member 386 retracts away from the drive head 14 in the axial direction, and therefore, the engagement between the coupling member 386 and the drive head 14 is broken. The cartridge B can be removed from the main assembly of the apparatus.

Also in this embodiment, like the Embodiment 1 and the Embodiment 2, the projection 386*c*1 of the coupling member 386 has a shape that expands in the radial direction of the coupling member 386 as it goes to the tip (free end) thereof. Therefore, in the process of mounting and dismounting the cartridge B, the projecting portion 386*c*1 can pass between the driving head 14 and the guide member 15.

In this embodiment, the lever 394 rotates as the user changes the attitude of the cartridge B when the cartridge B is mounted to or dismounted from the apparatus main assembly A. However, a mechanism for assisting the attitude change of the cartridge B may be provided in the apparatus main assembly A or the cartridge B when the cartridge B is mounted or removed. For example, a cartridge B is provided with a spring, and when the cartridge B is mounted or dismounting, the spring is brought into contact with the device main assembly A or is hooked. the attitude of the cartridge B is changed by the elastic force of the spring or the like in such an example.

Embodiment 4

Hereinafter, Embodiment 4 will be described referring to FIGS. 19 to 23. The coupling member (coupling unit U41) of this embodiment has a first portion (translating portion 499) and a second portion (inclining movement portion 494). The translating portion (first part) 499 is connected to the inclining movement portion 494 capable of tilting movement. As the inclining movement portion 494 is inclined and moved, the translating portion 499 of the coupling member moves forward and backward in the axial direction.

The translating portion 499 is a portion rotatable about the axis L2 and the inclining movement portion 494 is a portion rotatable about the axis L3.

Referring to FIG. 19 first, structure of the coupling unit U41 and the bearing unit U42 will be described.

Part (a) of FIG. 19 and part (b) of FIG. 19 are exploded perspective views of the coupling unit U41.

Part (c) of FIG. 19 and part (d) of FIG. 19 are exploded perspective views of the bearing unit U42 including the coupling unit U41. As shown in FIG. 19 (*a*) and FIG. 19 (*b*), the coupling unit U41 comprises the translating portion 499 of the coupling member, a rectilinear guide member 489, and a connecting member 488. The translation portion 499 of the coupling member is supported so as to be rotatable relative to the rectilinear guide member 489 by a shaft portion 499*a* being supported by a support portion 489*a*. And, a female threaded portion 499*b* is coupled with a male threaded portion 488*b*, by which the translating portion 499 of the coupling member and the connecting member 488 are integrally coupled. Here, the translating portion 499 of the coupling member has a coupling portion 499*c* on the side opposite to the female screw portion 499*b* in the direction of the axis L2. The connecting member 488 also has a cavity 488*c* on the side opposite to the male threaded portion 488*b* in the direction of the axis L2 and a hole 488*d* communicating with the cavity 488*c*.

As shown in part (c) of FIG. 19 and part (d) of FIG. 19, the bearing unit U42 comprises the coupling unit U41, an operation member (slide member 490), a compression spring 491, and a bearing member 492. The slide guide 490 is movably connected a bearing member 492*d* so as to be rotatable in the direction perpendicular to the axis L2 by a guided portion 490*d* being supported by the guide groove 492*d* of the bearing member 492. The sliding member 490 is an operating member which moves the coupling unit U41 by linear movement thereof.

Here, the direction in which the slide guide 490 can move is the same as the mounting direction (arrow X2 direction) of the cartridge B as will be described hereinafter. Between the slide guide 490 and the bearing member 492, the compression spring 491 is provided so as to be supported by a projection 490*c* and a projection 492*c*. By this, the slide guide 490 is urged to move relative to the bearing member 492 in the direction of the arrow X2. The supported unit 489*b* of the rectilinear guide unit 489 is press-fitted and fixed to the support unit 490*a* of the slide guide 490, by which the coupling unit U41 is connected to the slide guide 490. With the above-described structure, the translating portion 499 of the coupling member is connected to the bearing member 492 so as to be movable in the direction of the axis L2 and the mounting direction (arrow X2) relative to the bearing member 492.

Referring to FIG. 20, the structure of the drive transmission unit U43 will be described. FIG. 20 is an exploded perspective view of the drive transmission unit U43. As shown in FIG. 20 (*a*) and FIG. 20 (*b*), the drive transmission unit U43 comprises the bearing unit U42, the inclined moving portion 494, and a connecting pin 493. The inclining movement portion 494 is provided with a first spherical portion 494*a* and a second spherical portion 494*c*. The first spherical portion 494*a* is provided with a hole portion 494*b*, and the second spherical portion 494*c* is provided with a projection portion 494*d*. The first spherical portion 494*a* is inclinably fitted into the cavity portion 488*c* of the connecting member 488, and the pin 493 communicates the hole portion 488*d* of the connecting member 488 with the hole portion 494*b* of the inclining movement portion 494. By this, the connecting member 488 and the inclining movement portion 494 are connected so as to be inclined along the spherical surface of the first spherical portion 494*a*.

Further, referring to FIG. 21, a structure in which the drive transmission unit U43 is connected to the drum cylinder 62 will be described.

Part (a) of FIG. 21 is an exploded perspective view of the cleaning unit 61, and FIG. 21 (*b*) is a perspective view illustrating only the drum cylinder 62, a drive side flange (drum gear) 487, and the inclined movement portion 494. As shown in FIG. 21 (*a*), a driving side flange 487 is fixed to a driving side end portion of the drum cylinder 62. In the drive transmission unit U43, the bearing member 492 is fixed to the cleaning frame 71 and rotatably supports the driving side flange 487. As shown in FIG. 21 (*b*), the drive side flange 487 is provided with a cavity 487*a*, a rear end retaining portion 487*c* a second retaining portion 487*d* which project radially inward from the cavity 487*a*, and a drive transmission portion 487*b* communicating with the hollow portion 487*a* are provided. The inclining movement portion 494 is connected so that the second spherical portion 494*c* fits into the cavity portion 487*a* and the projecting portion 494*d* fits into the drive transmission portion 487*b*, respectively. Here, the inner diameter of the second retaining portion 487*d* is slightly smaller than the second spherical portion 494*c*. When inserting the second spherical portion 494*c* into the cavity portion 487*a*, the second stopper portion 487*d* is deformed to allow entry of the second spherical portion 494*c* into the hollow portion 487*a*, and after the assembly is completed, the second spherical portion prevents the second spherical portion 494*c* from disengaging from the hollow portion 487*a*. With the above-described structure, the inclining movement portion 494 is connected to the driving side flange 487 so as to be inclinable about the second spherical portion 494*c*.

Referring to FIG. 22, the operation of the translating portion 499 of the coupling member in the cartridge B of this embodiment will be described.

Part (a) of FIG. 22 is a side view as viewed from the outside of the drive side, and part (b) of FIG. 22 and part (c) of FIG. 22 are sectional views taken along a line S8, in which the translating portion 499, the connecting member 488 and the inclining movement portion 494 are shown without sectional view for better illustration. FIG. 22 (*b*) shows a state in which the rotation axis L2 of the translating unit 499 and the rotation axis L1 of the driving side flange 487 are aligned with each other, and FIG. 22 (*c*) shows a state where the axis L1 and the axis L2 are not aligned with each other. As shown in FIG. 22 (*b*), when the axis L2 is aligned with the axis L1, the inclined moving portion 494 stands upright and the compression spring 491 is in a compressed state. On the other hand, as shown in FIG. 22 (*c*), when the urging force of the compression spring 491 is imparted to move the slide guide 490 in the direction of the arrow X2, the inclining movement portion 494 moves in the direction of the arrow R8 with the movement of the translating portion 499. Then, the translating portion 499 moves in the direction of the arrow X5 as if it is pulled by the first spherical portion 494*a* together with the connecting member 488. in this manner, when the axis L1 and the axis L2 are aligned with each other, the translation portion 499 most projects to the outside of the drive side, and also moves in the direction of the arrow X5 along with the movement in the direction of the arrow X2 from this state. Further, by the compression spring 491, the translating portion 499 is urged to move in the direction of the arrow X2 and the direction of the arrow X5.

Referring to FIG. 23, the operation of the translating portion 499 when this cartridge B is mounted on the apparatus main assembly A will be described. FIG. 23 is an illustration of the mounting operation of the cartridge B. FIG. 23 (a1) to (a3) sequentially shows the state in which the cartridge B is mounted, and FIG. 23 (a3) is the state in which the mounting is completed. Part (b1) of FIG. 23 to 23 (b3) are sectional views of part (a1) of FIG. 23 to 23 (a3) taken along a line S9. For the sake of better illustration, the translating portion 499, the connecting member 488, and the inclining movement portion 494 are shown in non-sectional state. When mounting the cartridge B to the main unit A, by the compression spring 491 acts and the translation unit 499 has moved in the direction of the arrow X5 (and the arrow X2 (and arrow X2)) as shown in part (a1) of FIGS. 23 and 23 Direction). Then, the projecting portion 499*c*1 of the translating portion 499 passes the leading end of the driving head 14, and the cartridge B can be mounted. When the projecting portion 499*c*1 reaches the downstream side in the mounting direction X2 of the drive head 14, the leading end portion 490*e* of the slide guide 490 comes into contact with the terminal end portion 12*e*, as shown in FIG. 23 (a2) and FIG. 23 (b2). When the cartridge B is further moved to the mounting direction X2 side, the translation portion 499 starts to move so that the axis L2 approaches the axis L1 and projects in the direction of the arrow X4. Finally, as shown in FIG. 23 (b3), the axis L2 coincides with the axis L1, the translating portion 499 projects to the driving side and becomes engageable with the driving head 14.

On the other hand, when taking the cartridge B out of the apparatus main assembly A, the translating portion 499, the inclined moving portion 494, and the slide guide 490 perform an operation in a direction opposite to that when the cartridge B is mounted.

The translating portion 499 retracts away from the driving head 14, and therefore, the engagement between the translating portion 499 and the driving head 14 is broken, and the cartridge B can be dismounted from the main assembly A of the apparatus.

Also in this embodiment, like the first to Embodiment 3s, the projection 499*c*1 of the translating portion 499 has a shape that expands in the radial direction of the translating portion 499 toward the tip (free end) thereof. Therefore, in the insertion and removal process of the cartridge B, the projecting portion 499c1 can pass between the driving head 14 and the guide member 15.

The structure of this embodiment is summarized as follows. As the inclining movement portion 494 is inclined, the translating portion 499 moves along the axis L2. FIG. 22 (*b*) shows a state in which the coupling member (coupling unit U41) is in the projecting position (first position). In this state, the inclination of the axis L3 of the inclining movement portion 494 relative to the axis L2 of the translating portion 499 is small, and in this embodiment the angle of the axis L3 with respect to the axis L2 is substantially zero. At this time, the axis L3 and the axis L2 are substantially coaxial with the axis L1 of the drum cylinder 62.

On the other hand, FIG. 22 (*c*) shows a state in which the coupling member (coupling unit U41) is in the retracted position (second position). In this state, the inclining movement portion 494 is inclined with respect to the translating portion 499. In other words, the axis L3 is larger in angle with respect to the axis L2 than when the coupling member (coupling unit U41) is at the projecting position (first position).

By the coupling member (coupling unit U41) moving from the projecting position shown in FIG. 22 (*b*) to the retracted position shown in FIG. 22 (*c*), the translating portion 499 moves along the axis L2. At this time, the axis L2 of the translating portion 499 is kept substantially parallel to the axis L1 of the drum flange 62.

When the translating portion 499 moves along the axis L2, the distance between the axis L2 and the axis L1 changes. In other words, as the coupling member (coupling unit U41) moves from the projecting position to the retracted position, the distance between the axis L2 and the axis L1 increases.

Further, the translating portion 499 is provided with a projecting portion 499c (see FIG. 19). The projecting portion 499c has the same shape as the projecting portion 86c1 in the Embodiment 1.

In the first to Embodiment 4s, the interference of the drive head 14 with the coupling member is avoided by retracting the coupling member (that is, positioning it at the retracted position) when mounting the cartridge B and removing the cartridge B. At this time, not only the coupling member but also the drive head 14 may be retracted.

In other words, the drive head 14 may be mounted to the apparatus main assembly A with some play in its axial direction. In that case, the drive head 14 can move along the direction of the axis L4 by the play.

When mounting or dismounting the cartridge B to or from the apparatus main assembly A, it is possible that when the coupling member and the driving head 14 come into contact with each other, the driving head 14 receives a force from the coupling member and retracts away from the coupling member.

INDUSTRIAL APPLICABILITY

A drum unit for a process cartridge capable of receiving a driving force from an image forming apparatus at an end portion is provided.

DESCRIPTION OF REFERENCE NUMERALS

62: drum cylinder

86: coupling member

The invention claimed is:

1. A drum unit usable with a process cartridge, the drum unit comprising:

a photosensitive drum having an axis L1; and a coupling member having an axis L2 and operatively connected to an end portion of the photosensitive drum, the coupling member being provided with a projection extending toward an end portion of the coupling member, wherein the coupling member is movable along the axis L2 between a first position and a second position in which the projection is closer to the photosensitive drum than in the first position, wherein the projection is provided with a force receiving portion for receiving a rotational force and an outer surface facing away from the axis L2, and wherein at least a part of the outer surface increases in distance from the axis L2 as the distance further from the photosensitive drum increases in a direction of the axis L1.

2. The drum unit according to claim 1, wherein a distance from the axis L2 to the outer surface of the projection is largest at a tip of the projection.

3. The drum unit according to claim 1, wherein the projection has an inner surface facing the axis L2, and at least a part of the inner surface is more distant from the axis L2 as is further from the photosensitive drum in the direction of the axis L1.

4. The drum unit according to claim 3, wherein a distance from the axis L2 to the inner surface of the projection is largest at a tip of the projection.

5. The drum unit according to claim 1, further comprising:

a drum flange provided at an end portion of the photosensitive drum, the drum flange being coaxial with the photosensitive drum, wherein the coupling member is operatively connected to the end portion of the photosensitive drum by the way of the drum flange.

6. The drum unit according to claim 1, wherein the coupling member is provided with a plurality of such projections.

7. The drum unit according to claim 1, wherein the coupling member is movable while keeping the axis L2 parallel with the axis L1.

8. The drum unit according to claim 1, wherein the coupling member is movable while keeping the axis L2 coaxial with the axis L1.

9. The drum unit according to claim 1, wherein the coupling member includes a first portion having the axis L2 and provided with the projection, and wherein the coupling member further includes a second portion having an axis L3, the second portion being inclinable relative to the first portion to move the first portion along the axis L2.

10. The drum unit according to claim 9, wherein a distance between the axis L2 and the axis L1 changes by movement of the first portion along the axis L2.

11. The drum unit according to claim 1, wherein the outer surface of the projection increases in distance from the axis L2 throughout the length of the projection to the end portion of the coupling member as the distance from the photosensitive drum increases in a direction of the axis L1.

12. A drum unit usable with a process cartridge, the drum unit comprising:

a photosensitive drum having an axis L1; and a coupling member having an axis L2 and operatively connected to an end portion of the photosensitive drum, the coupling member being movable along the axis L2 and being provided with a projection extending in a direction away from the photosensitive drum, wherein the projection has an outer surface facing away from the axis L2, at least a part of the outer surface increases in distance from the axis L2 as the distance from the photosensitive drum increases in a direction of the axis L1, and a tip of the projection is a part of the coupling member most distant from the photosensitive drum and is a part of the projection most distant from the axis L2.

13. The drum unit according to claim 12, further comprising:

a drum flange provided at an end portion of the photosensitive drum, the drum flange being coaxial with the photosensitive drum, wherein the coupling member is operatively connected to the end portion of the photosensitive drum by the way of the drum flange.

14. The drum unit according to claim 12, wherein the coupling member is provided with a plurality of such projections.

15. The drum unit according to claim 12, wherein the coupling member is movable while keeping the axis L2 parallel with the axis L1.

16. The drum unit according to claim 12, wherein the coupling member is movable while keeping the axis L2 coaxial with the axis L1.

17. The drum unit according to claim 12, wherein the coupling member includes a first portion having the axis L2 and provided with the projection, and wherein the coupling member further includes a second portion having an axis L3, the second portion being inclinable relative to the first portion to move the first portion along the axis L2.

18. The drum unit according to claim 17, wherein a distance between the axis L2 and the axis L1 changes by movement of the first portion along the axis L2.

19. The drum unit according to claim 12, wherein the outer surface of the projection increases in distance from the axis L2 throughout the length of the projection to the tip of the projection as the distance from the photosensitive drum increases in a direction of the axis L1.

20. A drum unit usable with a process cartridge, the drum unit comprising:

a photosensitive drum having an axis L1; and a coupling member having an axis L2 and operatively connected to an end portion of the photosensitive drum, the coupling member being movable along the axis L2 and provided with a projection extending in a direction away from the photosensitive drum, wherein the projection has an inner surface facing the axis L2, at least a part of the inner surface increases in distance from the axis L2 as the distance from the photosensitive drum increases in a direction of the axis L1, and a tip of the projection is a part of the coupling member most distant from the photosensitive drum and the tip is a part of the projection most distant from the axis L2.

21. The drum unit according claim 20, further comprising a drum flange provided at an end portion of the photosensitive drum, the drum flange being coaxial with the photosensitive drum, and the coupling member being operatively connected to the end portion of the photosensitive drum by the way of the drum flange.

22. The drum unit according to claim 20, wherein the coupling member is provided with a plurality of such projections.

23. The drum unit according to claim 20, wherein the coupling member is movable while keeping the axis L2 parallel with the axis L1.

24. The drum unit according to claim 20, wherein the coupling member is movable while keeping the axis L2 coaxial with the axis L1.

25. The drum unit according to claim 20, wherein the coupling member includes a first portion having the axis L2 and provided with the projection, and the coupling member further includes a second portion having an axis L3, the second portion being inclinable relative to the first portion to move the first portion along the axis L2.

26. The drum unit according to claim 25, wherein a distance between the axis L2 and the axis L1 changes by movement of the first portion along the axis L2.

27. The drum unit according to claim 20, wherein the inner surface of the projection increases in distance from the axis L2 throughout the length of the projection to the tip of the projection as the distance from the photosensitive drum increases in a direction of the axis L1.

* * * * *